US011931615B2

(12) United States Patent
Lagree et al.

(10) Patent No.: US 11,931,615 B2
(45) Date of Patent: Mar. 19, 2024

(54) EXERCISE MACHINE RESISTANCE SELECTION SYSTEM

(71) Applicant: Lagree Technologies, Inc., Chatsworth, CA (US)

(72) Inventors: Sebastien Anthony Louis Lagree, Chatsworth, CA (US); Max E. Wunderlich, Los Angeles, CA (US)

(73) Assignee: Lagree Technologies, Inc., Chatsworth, CA (US)

( * ) Notice: Subject to any disclaimer, the term of this patent is extended or adjusted under 35 U.S.C. 154(b) by 364 days.

(21) Appl. No.: 17/374,440

(22) Filed: Jul. 13, 2021

(65) Prior Publication Data

US 2023/0017705 A1 Jan. 19, 2023

(51) Int. Cl.

| | |
|---|---|
| ***A63B 21/00*** | (2006.01) |
| ***A63B 21/04*** | (2006.01) |
| ***A63B 22/20*** | (2006.01) |

(52) U.S. Cl.

CPC .... *A63B 21/00069* (2013.01); *A63B 21/0428* (2013.01); *A63B 21/154* (2013.01); *A63B 22/203* (2013.01)

(58) Field of Classification Search

CPC ..... A63B 21/00069; A63B 21/0428; A63B 21/154; A63B 22/203; A63B 21/00065; A63B 21/023; A63B 22/0089

See application file for complete search history.

(56) References Cited

U.S. PATENT DOCUMENTS

| | | | |
|---|---|---|---|
| 131,886 | A | 10/1872 | Little |
| 339,638 | A | 4/1886 | Goldie |
| 1,621,477 | A | 8/1925 | Pilates |
| 3,770,267 | A | 11/1973 | McCarthy |

(Continued)

FOREIGN PATENT DOCUMENTS

| | | | |
|---|---|---|---|
| JP | 106278 | A | 1/1998 |
| KR | 1020040097734 | B1 | 11/2004 |

(Continued)

OTHER PUBLICATIONS

PCT International Search Report and Written Opinion for PCT/US2015/047763 from the Korean Intellectual Property Office; dated Nov. 19, 2015.

(Continued)

*Primary Examiner* — Andrew S Lo
(74) *Attorney, Agent, or Firm* — Neustel Law Offices

(57) ABSTRACT

An exercise machine resistance selection system for efficiently and easily adjusting a resistance force applied against movement of a carriage in at least one direction. An exercise machine includes a frame having at least one rail and a carriage movably connected to the at least one rail. A biasing member is selectively and removably connected to the carriage by a first catch member, with the first catch member being adjustable between an engaged position in which the first catch member is adapted to engage with the biasing member to impart a resistance force against movement of the carriage and a disengaged position in which the first catch member is adapted to release biasing member. A first retaining member is adapted to retain the biasing member in place below the carriage when the biasing member is released from the first catch member.

21 Claims, 25 Drawing Sheets

(56) References Cited

U.S. PATENT DOCUMENTS

| | | | |
|---|---|---|---|
| 3,806,094 | A | 4/1974 | Harken |
| 4,013,068 | A | 3/1977 | Settle |
| 4,759,540 | A | 7/1988 | Yu |
| 4,798,378 | A | 1/1989 | Jones |
| 5,066,005 | A | 11/1991 | Luecke |
| 5,201,694 | A | 4/1993 | Zappel |
| 5,263,913 | A | 11/1993 | Boren |
| 5,295,935 | A | 5/1994 | Wang |
| 5,316,535 | A | 5/1994 | Bradbury |
| 5,365,934 | A | 11/1994 | Leon |
| D362,700 | S | 9/1995 | Breibart |
| D382,319 | S | 8/1997 | Gerschefske |
| 5,681,249 | A | 10/1997 | Endelman |
| 5,738,104 | A | 4/1998 | Lo |
| 5,812,978 | A | 9/1998 | Nolan |
| 5,885,197 | A | 3/1999 | Barton |
| 5,967,955 | A | 10/1999 | Westfall |
| 5,989,163 | A | 11/1999 | Rodgers, Jr. |
| 6,045,491 | A | 4/2000 | McNergney |
| 6,152,856 | A | 11/2000 | Studor |
| 6,179,753 | B1 | 1/2001 | Barker |
| 6,261,205 | B1 | 7/2001 | Elefson |
| 6,626,802 | B1 | 9/2003 | Rodgers, Jr. |
| 6,790,162 | B1 | 9/2004 | Ellis |
| 6,790,163 | B1 | 9/2004 | Van De Laarschot |
| 6,929,589 | B1 | 8/2005 | Bruggemann |
| 7,108,635 | B2 | 9/2006 | Howlett-Campanella |
| 7,163,500 | B2 | 1/2007 | Endelman |
| 7,192,387 | B2 | 3/2007 | Mendel |
| 7,448,986 | B1 | 11/2008 | Porth |
| 7,537,554 | B2 | 5/2009 | Zhuang |
| 7,803,095 | B1 | 9/2010 | Lagree |
| 7,871,359 | B2 | 1/2011 | Humble |
| 7,878,955 | B1 | 2/2011 | Ehrlich |
| 7,914,420 | B2 | 3/2011 | Daly |
| 7,931,570 | B2 | 4/2011 | Hoffman |
| 7,967,728 | B2 | 6/2011 | Zavadsky |
| 8,162,802 | B2 | 4/2012 | Berg |
| 8,249,714 | B1 | 8/2012 | Hartman |
| 8,287,434 | B2 | 10/2012 | Zavadsky |
| 8,303,470 | B2 | 11/2012 | Stewart |
| 8,500,611 | B2 | 8/2013 | Hoffman |
| 8,585,554 | B2 | 11/2013 | Shavit |
| 8,641,585 | B2 | 2/2014 | Lagree |
| 8,812,075 | B2 | 8/2014 | Nguyen |
| 8,852,062 | B2 | 10/2014 | Dorsay |
| 8,911,328 | B2 | 12/2014 | Alessandri |
| 9,011,291 | B2 | 4/2015 | Birrell |
| 9,022,909 | B2 | 5/2015 | Kermath |
| 9,072,931 | B2 | 7/2015 | Lagree |
| 9,119,989 | B1 | 9/2015 | Lagree |
| 9,138,606 | B2 | 9/2015 | Lagree |
| 9,199,123 | B2 | 12/2015 | Solow |
| 9,211,440 | B2 | 12/2015 | Lagree |
| 9,283,422 | B2 | 3/2016 | Lagree |
| 9,370,679 | B2 | 6/2016 | Lagree |
| 9,393,454 | B2 | 7/2016 | Lagree |
| D764,606 | S | 8/2016 | Lagree |
| 9,415,253 | B2 | 8/2016 | Lagree |
| 9,457,216 | B2 | 10/2016 | Lagree |
| 9,457,225 | B2 | 10/2016 | Lagree |
| 9,474,924 | B2 | 10/2016 | Lagree |
| 9,474,926 | B1 | 10/2016 | Lagree |
| 9,474,927 | B2 | 10/2016 | Lagree |
| D772,992 | S | 11/2016 | Lagree |
| 9,498,667 | B1 | 11/2016 | Lagree |
| 9,517,375 | B2 | 12/2016 | Lagree |
| 9,522,299 | B2 | 12/2016 | Lagree |
| 9,533,184 | B1 | 1/2017 | Lagree |
| 9,533,185 | B1 | 1/2017 | Lagree |
| 9,545,535 | B2 | 1/2017 | Lagree |
| 9,555,282 | B1 | 1/2017 | Lagree |
| 9,579,536 | B1 | 2/2017 | Lagree |
| 9,579,555 | B2 | 2/2017 | Lagree |
| 9,586,081 | B2 | 3/2017 | Lagree |
| 9,586,089 | B2 | 3/2017 | Lagree |
| 9,597,545 | B1 | 3/2017 | Lagree |
| 9,604,095 | B1 | 3/2017 | Lagree |
| 9,604,097 | B1 | 3/2017 | Lagree |
| D785,104 | S | 4/2017 | Lagree |
| 9,643,051 | B1 | 5/2017 | Lagree |
| 9,649,526 | B2 | 5/2017 | Lagree |
| 9,649,527 | B1 | 5/2017 | Lagree |
| D789,463 | S | 6/2017 | Lagree |
| 9,700,754 | B2 | 7/2017 | Lagree |
| 9,717,945 | B2 | 8/2017 | Lagree |
| 9,744,395 | B1 | 8/2017 | Lagree |
| 9,776,043 | B2 | 10/2017 | Lagree |
| 9,776,062 | B2 | 10/2017 | Lagree |
| 9,789,354 | B2 | 10/2017 | Lagree |
| 9,808,664 | B2 | 11/2017 | Lagree |
| 9,849,330 | B2 | 12/2017 | Lagree |
| 9,868,009 | B2 | 1/2018 | Lagree |
| 9,868,010 | B2 | 1/2018 | Lagree |
| 9,868,011 | B2 | 1/2018 | Lagree |
| 9,868,018 | B2 | 1/2018 | Lagree |
| 9,868,019 | B2 | 1/2018 | Lagree |
| 9,914,014 | B2 | 3/2018 | Lagree |
| 9,962,573 | B2 | 5/2018 | Lagree |
| 9,962,592 | B2 | 5/2018 | Lagree |
| 9,981,156 | B2 | 5/2018 | Lagree |
| 10,016,655 | B2 | 7/2018 | Lagree |
| 10,022,577 | B2 | 7/2018 | Lagree |
| 10,022,581 | B2 | 7/2018 | Lagree |
| 10,029,141 | B2 | 7/2018 | Lagree |
| 10,046,193 | B1 | 8/2018 | Aronson |
| 10,052,518 | B2 | 8/2018 | Lagree |
| 10,065,069 | B1 | 9/2018 | Lagree |
| 10,109,216 | B2 | 10/2018 | Lagree |
| 10,118,067 | B2 | 11/2018 | Lagree |
| 10,124,232 | B2 | 11/2018 | Lagree |
| 10,143,882 | B2 | 12/2018 | Lagree |
| 10,150,003 | B2 | 12/2018 | Lagree |
| 10,155,129 | B2 | 12/2018 | Lagree |
| 10,201,724 | B2 | 2/2019 | Lagree |
| 10,213,641 | B2 | 2/2019 | Lagree |
| 10,220,244 | B2 | 3/2019 | Lagree |
| 10,238,910 | B2 | 3/2019 | Lagree |
| 10,265,573 | B2 | 4/2019 | Lagree |
| 10,272,285 | B2 | 4/2019 | Lagree |
| 10,279,207 | B2 | 5/2019 | Lagree |
| 10,300,328 | B2 | 5/2019 | Lagree |
| 10,369,398 | B2 | 8/2019 | Lagree |
| 10,478,656 | B2 | 11/2019 | Lagree |
| 10,478,663 | B2 | 11/2019 | Lagree |
| 10,486,017 | B1 | 11/2019 | Lagree |
| 10,493,321 | B2 | 12/2019 | Lagree |
| 10,500,441 | B2 | 12/2019 | Lagree |
| 10,518,127 | B2 | 12/2019 | Lagree |
| 10,549,140 | B2 | 2/2020 | Lagree |
| 10,561,896 | B2 | 2/2020 | Lagree |
| 10,569,118 | B2 * | 2/2020 | Lagree ..... A63B 21/00065 |
| 10,603,546 | B1 | 3/2020 | Lagree |
| 10,695,645 | B1 | 6/2020 | Lagree |
| 10,702,730 | B2 | 7/2020 | Lagree |
| 10,702,760 | B2 | 7/2020 | Lagree |
| 10,716,964 | B1 | 7/2020 | Lagree |
| 10,744,370 | B1 | 8/2020 | Lagree |
| 10,751,600 | B2 | 8/2020 | Lagree |
| 10,780,307 | B2 | 9/2020 | Lagree |
| 10,792,528 | B1 | 10/2020 | Lagree |
| 10,792,538 | B2 | 10/2020 | Lagree |
| 10,835,775 | B1 | 11/2020 | Lagree |
| 10,850,155 | B2 | 12/2020 | Lagree |
| 10,850,158 | B2 | 12/2020 | Lagree |
| 10,857,418 | B2 | 12/2020 | Lagree |
| 10,857,420 | B2 | 12/2020 | Lagree |
| 10,864,399 | B2 | 12/2020 | Lagree |
| 10,870,034 | B2 | 12/2020 | Lagree |
| 10,881,896 | B2 | 1/2021 | Lagree |
| 10,912,982 | B2 | 2/2021 | Lagree |
| 10,926,127 | B1 | 2/2021 | Lagree |
| 10,940,358 | B2 | 3/2021 | Lagree |
| 10,940,359 | B2 | 3/2021 | Lagree |

(56) References Cited

U.S. PATENT DOCUMENTS 10,946,230 B2 3/2021 Lagree
10,957,218 B1 3/2021 Lagree
10,974,089 B1 4/2021 Lagree
10,974,092 B2 4/2021 Lagree
10,994,168 B2 * 5/2021 Lagree ..... A63B 21/0056
11,000,727 B2 5/2021 Lagree
11,020,627 B1 6/2021 Lagree
11,040,234 B2 6/2021 Lagree
11,065,495 B1 * 7/2021 Savarino ..... A63B 21/023
2001/0056011 A1 * 12/2001 Endelman ..... A63B 22/0087 482/121
2002/0025888 A1 2/2002 Germanton
2002/0025891 A1 2/2002 Colosky, Jr.
2002/0082146 A1 6/2002 Steams
2002/0137607 A1 9/2002 Endelman
2003/0119635 A1 6/2003 Arbuckle
2004/0043873 A1 3/2004 Wilkinson
2005/0085351 A1 4/2005 Kissel
2005/0130810 A1 6/2005 Sands
2005/0164853 A1 7/2005 Naidus
2005/0164856 A1 7/2005 Parmater
2006/0046914 A1 3/2006 Endelman
2006/0105889 A1 5/2006 Webb
2006/0183606 A1 8/2006 Parmater
2006/0199712 A1 9/2006 Barnard
2007/0202992 A1 8/2007 Grasshoff
2007/0219053 A1 * 9/2007 Barufka ..... A63B 21/068 482/4
2007/0224582 A1 9/2007 Hayashino
2007/0270293 A1 11/2007 Zhuang
2008/0051256 A1 2/2008 Ashby
2008/0058174 A1 3/2008 Barnard
2008/0070765 A1 3/2008 Brown
2008/0139975 A1 6/2008 Einav
2008/0242519 A1 10/2008 Parmater
2008/0248935 A1 10/2008 Solow
2008/0254952 A1 10/2008 Webb
2009/0005698 A1 1/2009 Lin
2009/0023561 A1 1/2009 Ross
2009/0247376 A1 * 10/2009 Merrithew ..... A63B 22/203 482/121
2009/0291805 A1 11/2009 Blum
2009/0312152 A1 12/2009 Kord
2010/0016131 A1 1/2010 Hoffman
2010/0125026 A1 5/2010 Zavadsky
2010/0144499 A1 6/2010 Graham
2010/0227748 A1 9/2010 Campanaro
2010/0267524 A1 10/2010 Stewart
2011/0018233 A1 1/2011 Senner
2011/0039665 A1 2/2011 Dibble
2011/0077127 A1 3/2011 Ishii
2011/0143898 A1 6/2011 Trees
2011/0152045 A1 6/2011 Home
2011/0166002 A1 7/2011 Savsek
2011/0172069 A1 7/2011 Gerschefske
2011/0184559 A1 7/2011 Benabid
2012/0015334 A1 1/2012 Hamilton
2012/0088634 A1 4/2012 Heidecke
2012/0143020 A1 6/2012 Bordoley
2012/0190503 A1 * 7/2012 Shavit ..... A63B 24/0062 482/5
2012/0190505 A1 7/2012 Shavit
2012/0202656 A1 8/2012 Dorsay
2012/0228385 A1 9/2012 DeLuca
2012/0295771 A1 * 11/2012 LaGree ..... A63B 22/203 482/94
2013/0072353 A1 3/2013 Alessandri
2013/0150216 A1 6/2013 Bell
2013/0196835 A1 8/2013 Solow
2013/0210578 A1 8/2013 Birrell
2013/0210593 A1 * 8/2013 McBride ..... A63B 23/1218 482/142
2013/0289889 A1 10/2013 Yuen
2014/0011645 A1 1/2014 Johnson
2014/0066257 A1 3/2014 Shavit
2014/0087922 A1 3/2014 Bayerlein
2014/0100089 A1 4/2014 Kermath
2014/0121076 A1 5/2014 Lagree
2014/0121078 A1 5/2014 Lagree
2014/0121079 A1 * 5/2014 Lagree ..... A63B 21/00065 482/139
2014/0141948 A1 * 5/2014 Aronson ..... A63B 22/0087 482/128
2014/0148715 A1 5/2014 Alexander
2014/0213415 A1 7/2014 Parker
2014/0309087 A1 * 10/2014 Uygan ..... A63B 21/156 482/93
2015/0012111 A1 1/2015 Contreras-Vidal
2015/0024914 A1 1/2015 Lagree
2015/0057127 A1 2/2015 Lagree
2015/0065318 A1 3/2015 Lagree
2015/0072841 A1 3/2015 Lagree
2015/0105223 A1 4/2015 Bissu
2015/0141204 A1 5/2015 Lagree
2015/0217164 A1 8/2015 Lagree
2015/0220523 A1 8/2015 Lagree
2015/0246263 A1 9/2015 Campanaro
2015/0297944 A1 10/2015 Lagree
2015/0329011 A1 11/2015 Kawai
2015/0343250 A1 12/2015 Lagree
2015/0360068 A1 12/2015 Lagree
2015/0360083 A1 12/2015 Lagree
2015/0360113 A1 12/2015 Lagree
2015/0364058 A1 12/2015 Lagree
2015/0364059 A1 12/2015 Marks
2015/0367166 A1 12/2015 Lagree
2016/0008657 A1 1/2016 Lagree
2016/0059060 A1 3/2016 Lagree
2016/0059061 A1 * 3/2016 Lagree ..... A63B 21/4035 482/92
2016/0074691 A1 3/2016 Pearce
2016/0096059 A1 4/2016 Lagree
2016/0166870 A1 6/2016 Lagree
2016/0193496 A1 7/2016 Lagree
2016/0256733 A1 9/2016 Lagree
2016/0271452 A1 9/2016 Lagree
2016/0317858 A1 11/2016 Lagree
2016/0346593 A1 12/2016 Lagree
2016/0361602 A1 12/2016 Lagree
2017/0014664 A1 1/2017 Lagree
2017/0014672 A1 1/2017 Lagree
2017/0036057 A1 2/2017 Lagree
2017/0036061 A1 2/2017 Lagree
2017/0043210 A9 2/2017 Lagree
2017/0065846 A1 3/2017 Lagree
2017/0072252 A1 3/2017 Lagree
2017/0087397 A1 3/2017 Lagree
2017/0100625 A1 4/2017 Lagree
2017/0100629 A1 4/2017 Lagree
2017/0106232 A1 4/2017 Lagree
2017/0113091 A1 4/2017 Lagree
2017/0120101 A1 5/2017 Lagree
2017/0144013 A1 5/2017 Lagree
2017/0157452 A1 6/2017 Lagree
2017/0157458 A1 6/2017 Lagree
2017/0165518 A1 6/2017 Lagree
2017/0165555 A1 6/2017 Lagree
2017/0189740 A1 7/2017 Lagree
2017/0189741 A1 7/2017 Lagree
2017/0209728 A1 * 7/2017 Lagree ..... A63B 21/023
2017/0239526 A1 8/2017 Lagree
2017/0246491 A1 8/2017 Lagree
2017/0246499 A1 8/2017 Lagree
2017/0296865 A1 10/2017 Lagree
2017/0304673 A1 10/2017 Lagree
2017/0326406 A1 11/2017 Lagree
2017/0340947 A1 11/2017 Lagree
2017/0354840 A1 12/2017 Lagree
2018/0015319 A1 1/2018 Lagree
2018/0021621 A1 * 1/2018 Lagree ..... A63B 21/00065 482/129
2018/0021655 A1 1/2018 Lagree
2018/0036583 A1 2/2018 Lagree

(56) References Cited

U.S. PATENT DOCUMENTS

| | | | | |
|---|---|---|---|---|
| 2018/0056109 | A1 | 3/2018 | Lagree | |
| 2018/0056133 | A1 | 3/2018 | Lagree | |
| 2018/0111020 | A1 | 4/2018 | Lagree | |
| 2018/0111033 | A1 | 4/2018 | Lagree | |
| 2018/0117392 | A1 | 5/2018 | Lagree | |
| 2018/0133532 | A1 | 5/2018 | Lagree | |
| 2018/0133533 | A1 | 5/2018 | Lagree | |
| 2018/0133534 | A1 | 5/2018 | Lagree | |
| 2018/0133542 | A1 | 5/2018 | Lagree | |
| 2018/0178053 | A1 | 6/2018 | Lagree | |
| 2018/0193691 | A1 | 7/2018 | Lagree | |
| 2018/0250551 | A1 | 9/2018 | Lagree | |
| 2018/0250573 | A1 | 9/2018 | Lagree | |
| 2018/0272179 | A1 | 9/2018 | Lagree | |
| 2018/0280782 | A1 | 10/2018 | Lagree | |
| 2018/0318627 | A1 | 11/2018 | Lagree | |
| 2018/0318646 | A1 | 11/2018 | Lagree | |
| 2018/0326252 | A1 | 11/2018 | Lagree | |
| 2018/0353803 | A1 | 12/2018 | Lagree | |
| 2018/0361190 | A1 | 12/2018 | Lagree | |
| 2018/0361197 | A1 | 12/2018 | Lagree | |
| 2019/0083842 | A1 | 3/2019 | Lagree | |
| 2019/0160320 | A1 | 5/2019 | Lagree | |
| 2019/0160329 | A1 | 5/2019 | Lagree | |
| 2019/0232105 | A1 | 8/2019 | Lagree | |
| 2019/0240530 | A1 | 8/2019 | Lagree | |
| 2019/0247694 | A1 | 8/2019 | Lagree | |
| 2019/0247705 | A1 | 8/2019 | Lagree | |
| 2019/0247707 | A1 | 8/2019 | Lagree | |
| 2019/0255375 | A1 | 8/2019 | Lagree | |
| 2019/0269961 | A1 | 9/2019 | Lagree | |
| 2019/0314672 | A1 | 10/2019 | Lagree | |
| 2019/0358484 | A1 | 11/2019 | Lagree | |
| 2020/0030657 | A1 | 1/2020 | Lagree | |
| 2020/0047051 | A1 | 2/2020 | Lagree | |
| 2020/0054913 | A1 | 2/2020 | Lagree | |
| 2020/0078630 | A1 | 3/2020 | Lagree | |
| 2020/0078634 | A1 | 3/2020 | Lagree | |
| 2020/0129803 | A1* | 4/2020 | Janowski | A63B 23/03566 |
| 2020/0171337 | A1 | 6/2020 | Lagree | |
| 2020/0353306 | A1* | 11/2020 | Lagree | A63B 22/203 |
| 2020/0376326 | A1 | 12/2020 | Lagree | |
| 2020/0376359 | A1 | 12/2020 | Lagree | |
| 2021/0069542 | A1 | 3/2021 | Lagree | |
| 2021/0069572 | A1 | 3/2021 | Lagree | |
| 2021/0086023 | A1 | 3/2021 | Lagree | |
| 2021/0101048 | A1 | 4/2021 | Lagree | |
| 2021/0121734 | A1 | 4/2021 | Lagree | |
| 2021/0154555 | A1 | 5/2021 | Lagree | |
| 2021/0187343 | A1 | 6/2021 | Lagree | |
| 2021/0187345 | A1 | 6/2021 | Lagree | |

FOREIGN PATENT DOCUMENTS

| | | | |
|---|---|---|---|
| WO | 2004096376 | A1 | 11/2004 |
| WO | 2014084742 | A1 | 6/2014 |

OTHER PUBLICATIONS

PCT International Search Report and Written Opinion for PCT/US2015/047746 from the Korean Intellectual Property Office; dated Nov. 19, 2015.

http://www.puzzlebox.io/brainstorms/; Puzzlebox Brainstorms Website Article; Jun. 13, 2016.

http://tera.lunar-europe.com; TERA Fitness Mat; Lunar Europe; Jun. 8, 2014.

PCT International Search and Opinion from International Searching Authority for PCT/US2016/022888; dated Jul. 25, 2016.

PCT Preliminary Report on Patentability from International Searching Authority for PCT/US2016/022888; dated Sep. 28, 2017.

PCT International Search and Opinion from International Searching Authority for PCT/US2017/041638; dated Sep. 28, 2017.

http://www.cognionics.com/index.php/products/hd-eeg-systems/mobile-eeg-cap; Cognionics Mobile-72 Wireless EEG System; Jun. 14, 2016.

http://www.cognionics.com/index.php/products/mini-systems/dry-eeg-headband; Cognionics Dry EEG Headband; Jun. 14, 2016.

http://www.cognionics.com/index.php/products/mini-systems/multi-position-dry-headband; Cognionics Multi-Position Dry EEG Headband; Jun. 14, 2016.

http://www.cognionics.com/index.php/products/hd-eeg-systems/quick-20-dry-headset; Cognionics Quick-20 Dry EEG Headset; Jun. 14, 2016.

http://www.cognionics.com/index.php/products/hd-eeg-systems/72-channel-system; Cognionics HD-72 Overview; Jun. 14, 2016.

http://www.brainproducts.com/productdetails.php?id=63&tab=1; LiveAmp Overview; Jun. 14, 2016.

https://www.youtube.com/Watch?V=Xj2xuGsB3yo; Screenshot of YouTube Video "Iphone Free App (Dec. 16, 2010) Finger Balance"; Tuuske; Dec. 16, 2010.

PCT Preliminary Report on Patentability from International Searching Authority for PCT/US2017/041638; dated Jan. 24, 2019.

* cited by examiner

EXERCISE MACHINE RESISTANCE SELECTION SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

The described example embodiments in general relate to an exercise machine resistance selection system for efficiently and easily adjusting a resistance force applied against movement of a carriage in at least one direction.

Exercise machines have become ubiquitous in modern life. A wide range of exercise machines are available to the modern exerciser, such as but not limited to reformer machines in which a carriage is movably positioned upon rails. A typical reformer machine generally includes biasing members which are adapted to impart a resistance force against movement of the carriage upon the rails.

While reformer machines are effective tools for exercise, it is often desirable for an exerciser to adjust or vary the level of resistance force applied against movement of the carriage upon the rails. There are many reasons why one would desire to adjust the resistance for. By way of example, an exerciser may wish to "ramp up" her exercise by initially having a lower resistance level applied to the carriage and then subsequently increasing the resistance level during the course of her routine. Additionally, an exerciser may desire to test her limits by gradually increasing the resistance force until the upper limit of her abilities is reached.

While exercise machines in the past have allowed for variable resistances to be applied against movement of a carriage, such previous exercise machines can be sometimes difficult or clunky to operate. Additionally, such exercise machines may have complicated adjustment mechanisms that are difficult to change during exercises without interrupting the flow of an exercise routine. Or the mechanisms may be susceptible to getting jammed or needing repeated maintenance.

SUMMARY

Some of the various embodiments of the present disclosure relate to an exercise machine that allows for quick and easy adjustment of a resistance force applied against a movable carriage on at least one rail. Some of the various embodiments of the present disclosure include an exercise machine including a frame having at least one rail and a carriage movably connected to the at least one rail so as to be movable along a portion of the at least one rail. A biasing member may be connected to the frame, and an engagement member may be connected to the biasing member. A first catch member is movably connected to the carriage, with the first catch member being adjustable between an engaged position in which the first catch member is adapted to engage with the engagement member so as to impart a resistance force against movement of the carriage in at least one direction and a disengaged position in which the first catch member is adapted to release the engagement member. A first retaining member may be connected to the frame, with the first retaining member being adapted to retain the engagement member when the engagement member is released from the first catch member.

In some embodiments, the first catch member may be comprised of a pivotable hook and the first retaining member may be comprised of a fixed hook. In some other embodiments, a second retaining member may be distally-spaced with respect to the first retaining member and a second catch member may be distally-spaced with respect to the first catch member, thus creating a first gap between the first and second catch members and a second gap between the first and second retaining members. In some embodiments, the first gap may be narrower than the second gap such that the first and second catch members may fit between the first and second retaining members when engaged to the engagement member.

There has thus been outlined, rather broadly, some of the embodiments of the present disclosure in order that the detailed description thereof may be better understood, and in order that the present contribution to the art may be better appreciated. There are additional embodiments of that will be described hereinafter and that will form the subject matter of the claims appended hereto. In this respect, before explaining at least one embodiment in detail, it is to be understood that the various embodiments are not limited in its application to the details of construction or to the arrangements of the components set forth in the following description or illustrated in the drawings. Also, it is to be understood that the phraseology and terminology employed herein are for the purpose of the description and should not be regarded as limiting.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evidence to the contrary from the description, where elements in different figures use identical reference numbers, the elements are generally either identical or at least similar in function or purpose.

DETAILED DESCRIPTION

A. Overview

Figure 1:
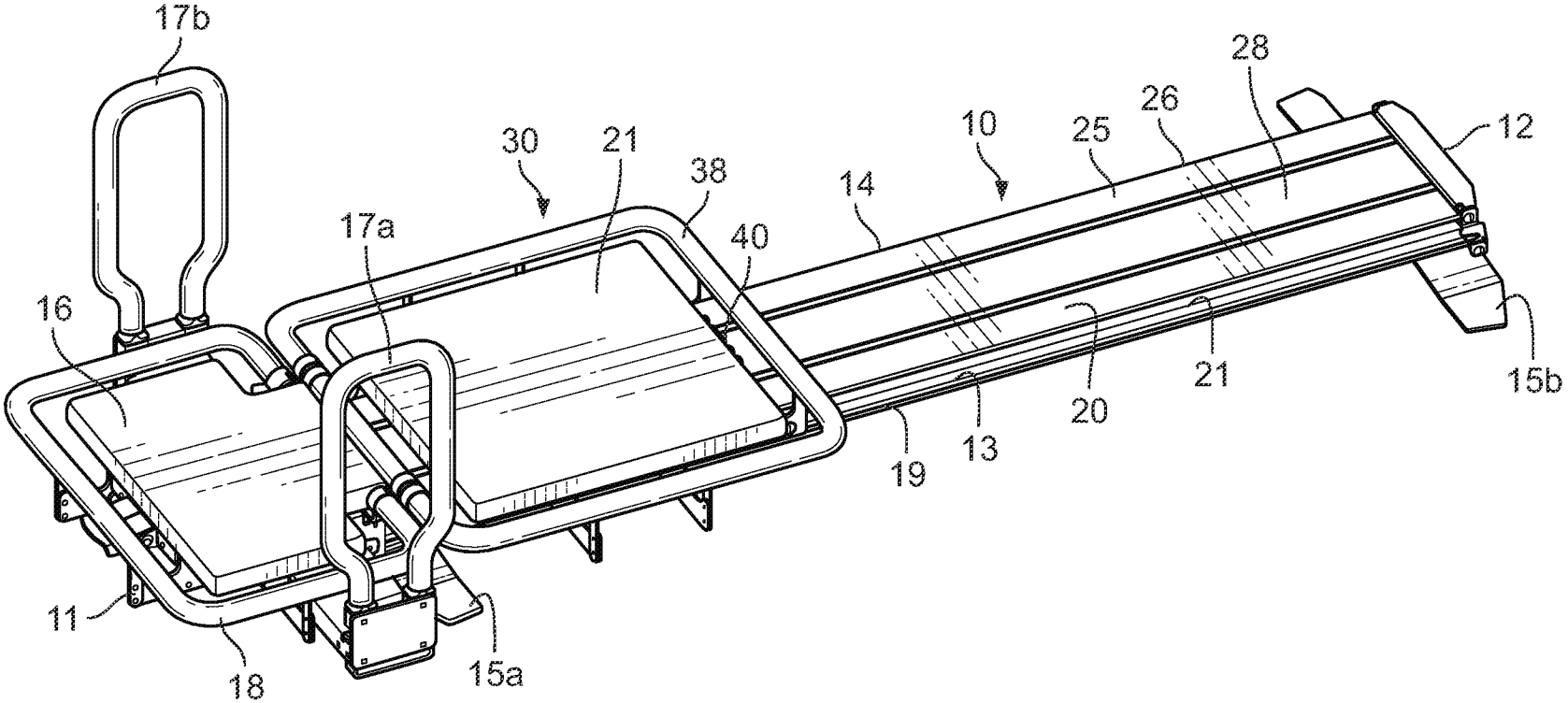
FIG. 1 is a perspective view of an exercise machine in accordance with an example embodiment.

Some of the various embodiments of the present disclosure relate to an exercise machine that can efficiently adjust a resistance force applied against a movable carriage in one or more directions. Some of the various embodiments of the present disclosure include an exercise machine 10 including a frame 19 having at least one rail 20, 25 and a carriage 30 movably connected to the at least one rail 20, 25 so as to be movable along a portion of the at least one rail 20, 25. A biasing member 70 may be connected to the frame 19, and an engagement member 66 may be connected to the biasing member 70. A first catch member 41 is movably connected to the carriage 30, with the first catch member 41 being adjustable between an engaged position in which the first catch member 41 is adapted to engage with the engagement member 66 so as to impart a resistance force against movement of the carriage 30 in at least one direction and a disengaged position in which the first catch member 41 is adapted to release the engagement member 66. A first retaining member 51 may be connected to the frame 19, with the first retaining member 51 being adapted to retain the engagement member 66 when the engagement member 66 is released from the first catch member 41.

In some example embodiments, an elongated member 60 may be connected to the biasing member 70, with the engagement member 66 being connected directly to the elongated member 60. In some other example embodiments, multiple biasing members 70 may be utilized, with each such biasing member 70 being selectively and removably interconnected with the carriage 30 by use of one or more catch members 41, 42.

In an exemplary embodiment, the exercise machine resistance system may comprise an exercise machine 10 including a frame 19 having at least one rail 20, 25. A carriage 30 is movably connected to the at least one rail 20, 25, with the carriage 30 adapted to be movable along a portion of the at least one rail 20, 25. A biasing member 70 is connected to the frame 19, and an engagement member 66 is connected to the biasing member 70.

A first catch member 41 is movably connected to the carriage 30, with the first catch member 41 being adjustable between an engaged position and a disengaged position. The first catch member 41 is adapted to engage with the engagement member 66 when the first catch member 41 is in the engaged position such that the biasing member 70 imparts a resistance force against movement of the carriage 30 in at least one direction. The first catch member 41 is adapted to release the engagement member 66 when the first catch member 41 is in the disengaged position. A first retaining member 51 may be connected to the frame 19, with the first retaining member 51 being adapted to retain the engagement member 66 when the engagement member 66 is released from the first catch member 41.

The first catch member 41 may be comprised of a first hook and the first retaining member 51 may be comprised of a second hook. The first catch member 41 may be connected to an underside of the carriage 30 and extend downwardly from the carriage 30. The first retaining member 51 may extend upwardly from the frame 19. An arm member 46 may be connected to the first catch member 41, with the arm member 46 extending at least partially from a first end of the carriage 30. A spring 48 may be connected to the first catch member 41 so as to bias the first catch member 41 towards the disengaged position.

A second catch member 42 may be movably connected to the carriage 30, with the second catch member 42 being distally-spaced with respect to the first catch member 41. A first gap may be defined between the first catch member 41 and the second catch member 42. A second retaining member 52 may be connected to the frame 19, with the second retaining member 52 being distally-spaced with respect to the first retaining member 51. A second gap may be defined between the first retaining member 51 and the second retaining member 52, with the second gap being wider than the first gap. The first catch member 41 and the second catch member 42 may thus fit within the second gap between the first retaining member 51 and the second retaining member 52.

The first catch member 41 may comprise a first opening 44*a* and the first retaining member 51 may comprise a second opening 54*a*, with the first opening 44*a* being concentric with the second opening 54*a* when the first catch member 41 is engaged with the engagement member 66. An elongated member 60 may be connected to the biasing member 70, with the engagement member 66 being connected to a distal end of the elongated member 60. The engagement member 66 may be perpendicular to the distal end of the elongated member 60. The engagement member 66 may be crosswise with respect to the biasing member 70. An end platform 16 may be connected at or near a first end 11 or a second end 12 of the frame 19.

B. Frame

As shown throughout the figures, the systems and methods described herein may be utilized in combination with an exercise machine 10 adapted for use by one or more exercisers to perform one or more exercise movements. The type of exercise machine 10 utilized may vary in different embodiments, and thus the exercise machine 10 may comprise various shapes, sizes, and configurations. The shape, size, and configuration of the exercise machine 10 should thus not be construed as limited by the exemplary figures.

The figures illustrate an exemplary exercise machine 10 which may be utilized in connection with the systems and methods described herein. The exercise machine 10 may be comprised of various types of exercise machines such as but not limited to a reformer exercise machine, exercise bicycle, rowing machine, elliptical trainer, treadmill, and the like. It should be appreciated that the exemplary embodiments shown in the figures are merely for illustrative purposes, and thus the scope should not be construed as limited to any particular exercise machine configuration shown in the figures.

As best shown in FIG. 1, the exercise machine 10 may comprise a first end 11, a second end 12, a first side 13, and a second side 14. The exercise machine 10 may comprise various structural elements which together form a frame 19. Generally, the exercise machine 10 will be comprised of both fixed elements (e.g., legs 15*a*, 15*b*, frame 19, and rails 20, 25) and movable elements (e.g., carriage 30). The frame 19 may comprise both fixed elements and movable elements in an exemplary embodiment.

The exercise machine 10 may comprise at least one rail 20, 25 upon which a carriage 30 may be movably positioned such that the carriage 30 may be moved in at least one direction (e.g., towards the first end 11 and/or towards the second end 12). In the exemplary embodiment shown in FIG. 1, the frame 19 of the exercise machine 10 is illustrated as comprising a pair of rails 20, 25, with a first rail 20 extending at least partially between the first and second ends 11, 12 of the exercise machine 10 along its first side 13 and a second rail 25 extending at least partially between the first and second ends 11, 12 of the exercise machine 10 along its second side 14.

It should be appreciated that the number of rails 20, 25 utilized may vary in different embodiments. In some embodiments, a pair of rails 20, 25 comprising a first rail 20 and a second rail 25 which is parallel with the first rail 20 may be utilized. In other embodiments, a single monorail may be utilized which is positioned centrally between the first and second sides 13, 14 of the exercise machine 10. In yet another embodiments, multiple rails 20, 25 may be utilized in combination with a spacer 28 to create the appearance of a monorail configuration.

In the exemplary embodiment best shown in FIG. 1, it can be seen that the frame 19 includes a first rail 20, a second rail 25, spacers 28, and lower members 29 connected between the first and second rails 20, 25. Such an embodiment allows for structures internal to the rails 20, 25, such as the biasing members 70, to be at least partially enclosed. Such a configuration prevents inadvertent injury by, for example, an exerciser inadvertently placing a limb between the rails 20, 25 to get caught in the biasing members 70 or other internal structures.

Figure 2A:
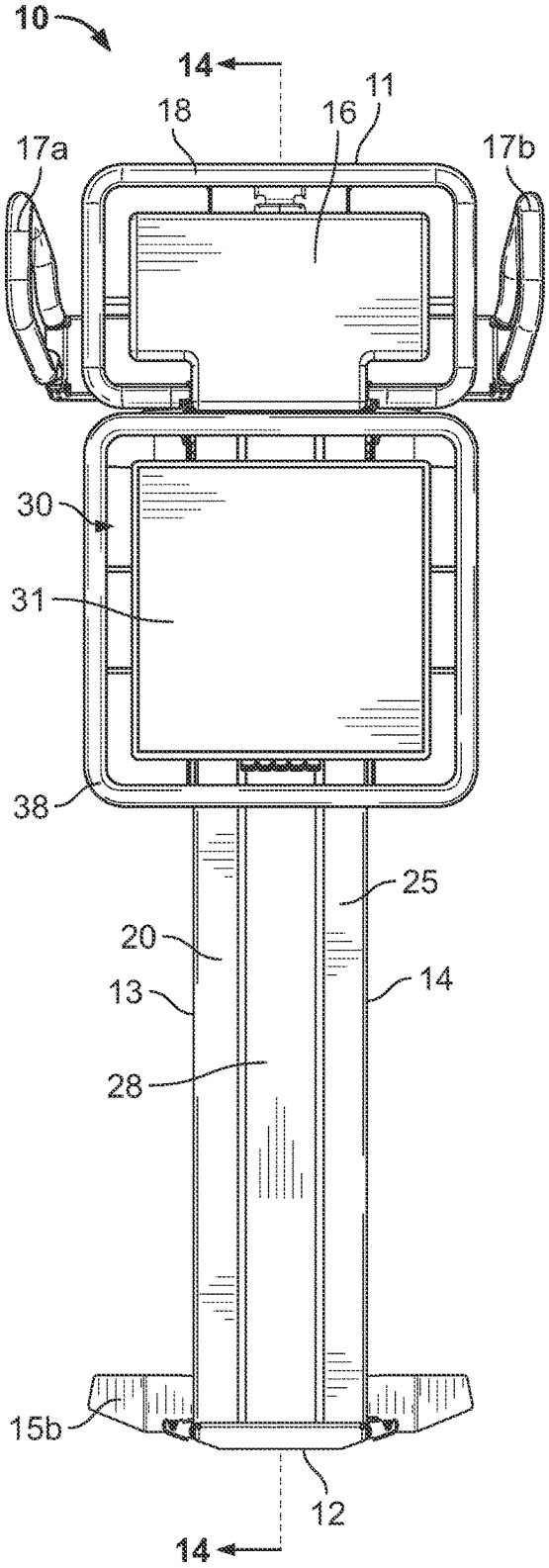
FIG. 2A is a top view of an exercise machine in accordance with an example embodiment.
Figure 2B:
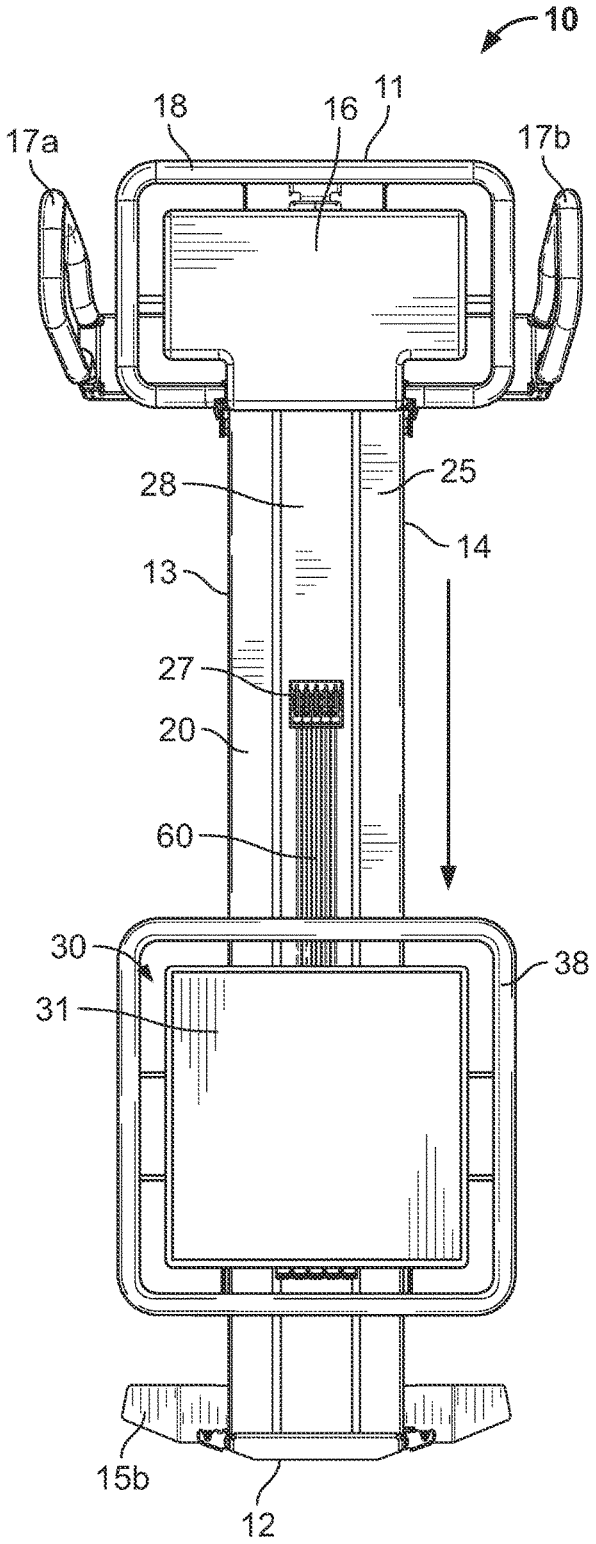
FIG. 2B is a top view of an exercise machine with the carriage moved from its resting position in accordance with an example embodiment.
Figure 17:
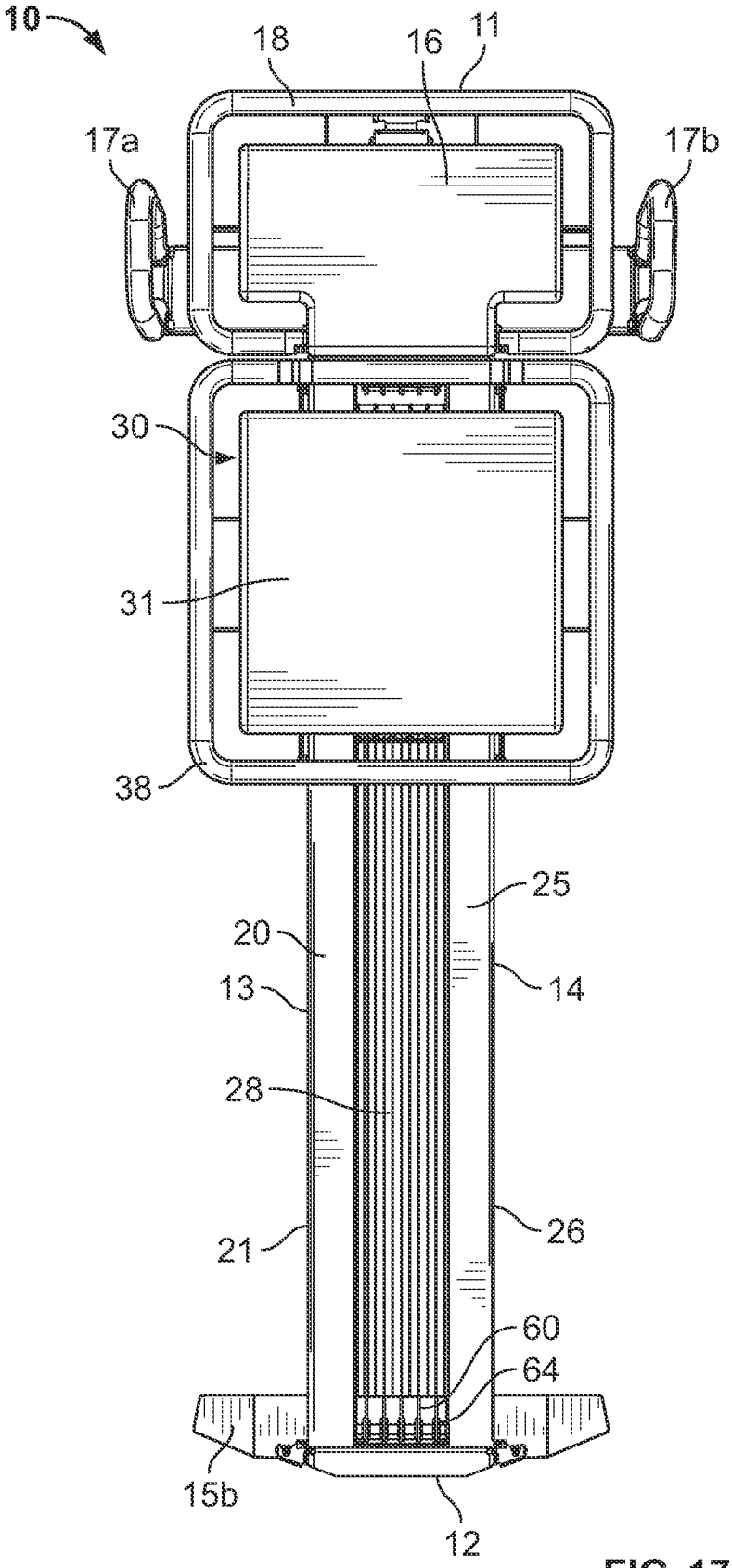
FIG. 17 is a top view of an exercise machine resistance selection system with an exercise machine using two separate rails in accordance with an example embodiment.

As best shown in FIGS. 1, 2A, and 2B, the rails 20, 25 may be enclosed at their upper ends by one or more spacers 28 and at their lower ends by one or more lower members 29. FIG. 17 illustrates an embodiment in which the spacers 28 have been omitted, with the space between the rails 20, 25 being exposed. As shown in FIGS. 9, 10A, 10B, 12-14, and 17, the lower member 29 may include a plurality of dividers 23 which define a plurality of slots, with each of the elongated members 60 and/or biasing members 70 being routed through one of the slots between a pair of the plurality of dividers 23. Such a configuration ensures that the elongated members 60 and/or biasing members 70 do not become tangled with each other. In some embodiments, however, the dividers 23 may be omitted.

As shown in FIG. 2B, in embodiments in which the space between the upper ends of the respective rails 20, 25 is covered by a spacer 28, an upper opening 27 may be utilized, with the retainers 50 and pulleys 58 extending at least partially through the upper opening 27 such that the elongated members 60 may be selectively engaged by the resistance selectors 40. In such an embodiment, any elongated members 60 connected to the carriage 30 will extend along the upper surface of the spacer 28 when the carriage 30 is pulled away such as shown in FIG. 2B.

As best shown in FIGS. 1, 2A, 2B, 2C, and 17, the exercise machine 10 will generally include a pair of rails 20, 25 on which a carriage 30 may be movably connected. The shape, size (e.g., length and width), positioning, and orientation of the rails 20, 25 may vary in different embodiments, and thus should not be construed as limited by the exemplary embodiments shown in the figures. Through the use of spacers 28, the pair of rails 20, 25 may have the appearance of a single monorail such as shown in FIG. 1.

Each of the rails 20, 25 generally comprise an elongated member. The material utilized for the rails 20, 25 may vary in different embodiments. The rails 20, 25 may be comprised of various metals, metal alloys, plastics, woods, and/or composite materials in different embodiments. The rails 20, 25 may be substantially tubular, with a hollow interior.

The rails 20, 25 may be parallel to each other, or may be slightly angled away from or towards each other. The spacing between the rails 20, 25 will vary in different embodiments. As shown in FIGS. 1, 2A, 2B, 2C, and 17, a first rail 20 may extend between the first and second ends 11, 12 of the exercise machine 10 at or near the first side 13 of the exercise machine 10. The first rail 20 may extend the full length of the exercise machine 10 between the first and second ends 11, 12 thereof, or may extend for less than the full length of the exercise machine 10.

The first rail 20 may include a first outer channel 21 as shown in FIG. 1. The first outer channel 21 will generally comprise a channel formed within the outer edge of the first rail 20. The shape and size of the first outer channel 21 may vary in different embodiments, and should not be construed as limited by the exemplary embodiments shown in the figures. By way of example, the first outer channel 21 may have a reversed C-shape such that the first wheels 33*a*, 33*b* connected to the carriage 30 may be guided along and may be moved within the first outer channel 21.

As shown in FIGS. 1, 2A, 2B, 2C, and 17, a second rail 25 may extend between the first and second ends 11, 12 of the exercise machine 10 at or near the second side 14 of the exercise machine 10. The second rail 25 may extend the full length of the exercise machine 10 between the first and second ends 11, 12 thereof, or may extend for less than the full length of the exercise machine 10.

The second rail 25 may include a second outer channel 26. The second outer channel 26 will generally comprise a channel formed within the outer edge of the second rail 25. The shape and size of the second outer channel 26 may vary in different embodiments, and should not be construed as limited by the exemplary embodiments shown in the figures. By way of example, the second outer channel 26 may have a C-shape such that the second wheels 35*a*, 35*b* connected to the carriage 30 may be guided along and may be moved within the second outer channel 26.

C. Carriage

As shown throughout the figures, the exercise machine 10 generally includes a carriage 30 which is movably positioned upon the first and second rails 20, 25 such that the carriage 30 may move along at least a portion of the length of the first and second rails 20, 25. In an exemplary embodiment, the carriage 30 is adapted to move back and forth along at least a portion of the length of the first and second rails 20, 25 in a reciprocating manner. The carriage 30 typically includes a plurality of wheels 33*a*, 33*b*, 35*a*, 35*b* or other movable structures that movably engage with the first and second rails 20, 25 of the exercise machine 10.

In an exemplary embodiment such as shown in FIG. 1, the carriage 30 is illustrated as comprising a platform 31 at its upper end. An exerciser will generally positioned one or more body parts on the upper surface of the platform 31 when performing various exercise moves. The lower surface of the carriage 30 may be positioned over the first and second rails 20, 25, which function as a track for the carriage 30 to move along.

Figure 6:
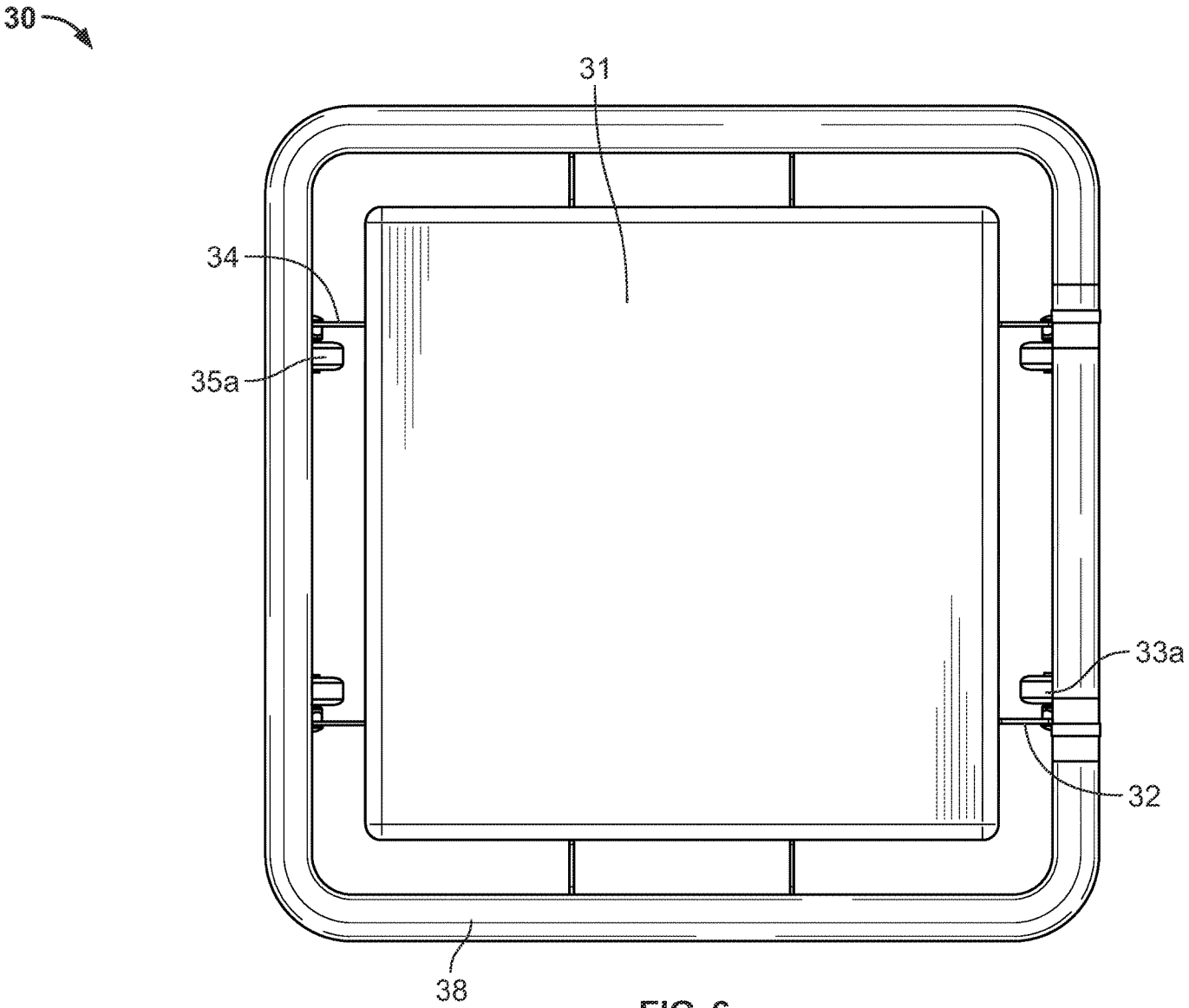
FIG. 6 is a top view of a carriage of an exercise machine resistance selection system in accordance with an example embodiment.

The carriage 30 may include various handles, cutouts, and the like which an exerciser may grasp or contact with various limbs during the performance of a wide range of exercises. In the exemplary embodiment shown in FIG. 6, the carriage 30 is shown as including a perimeter handle 38 surrounding the carriage 30. It should be appreciated that such a configuration is merely for exemplary purposes, and thus should not be construed as limiting in scope.

The shape, size, and configuration of the carriage 30 may vary in different embodiments, and thus should not be construed as limited by the exemplary embodiments shown in the figures. The carriage 30 will generally comprise a substantially-rectangular shape such as shown in the figures, though other shapes may be utilized in different embodiments. The length and width of the carriage 30 may vary depending on the embodiment so as to suit different types of exercisers. A large bodybuilder would benefit from a longer and wider carriage 30 than a more cardio-based exerciser with perhaps a smaller stature. Thus, the dimensions of the carriage 30 shown in the exemplary figures should not be construed as limiting in scope.

U.S. Pat. Nos. 10,716,964, 10,155,129, 9,604,095, 9,579,555 and 7,803,095 disclose example exercise machines with a movable carriage, the entire disclosures of which, except for any definitions, disclaimers, disavowals, and inconsistencies, are incorporated herein by reference.

As shown in the figures, the carriage 30 will generally be movably positioned or connected to the first and second rails 20, 25. The manner in which the carriage 30 is movably positioned or connected to the first and second rails 20, 25 may vary in different embodiments. In some embodiments, portions of the carriage 30 may mate with the first and second rails 20, 25 such that the carriage 30 may slide upon the first and second rails 20, 25. In other embodiments, magnets such as magnetic levitation may be utilized.

Figure 7:
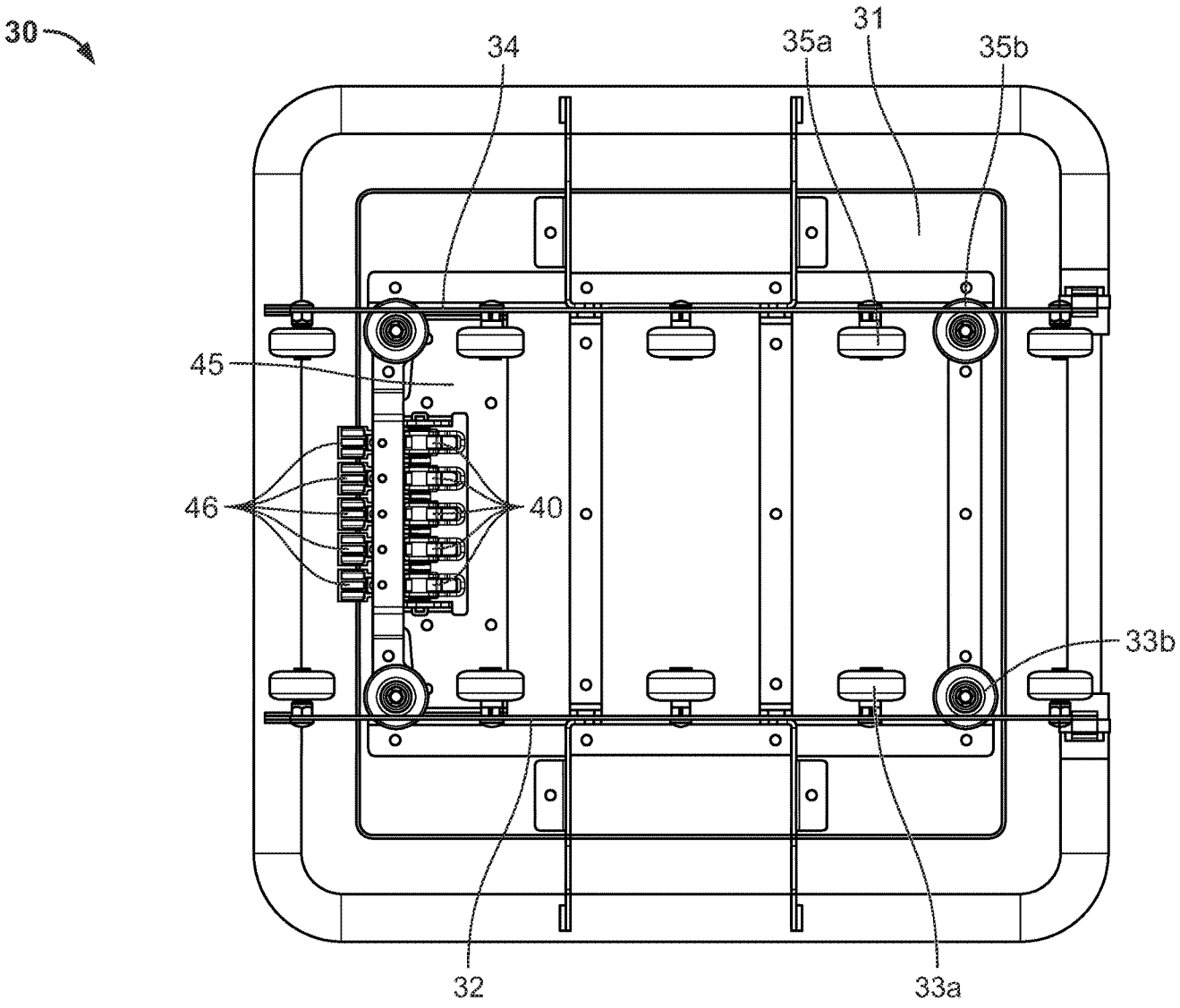
FIG. 7 is a bottom view of a carriage of an exercise machine resistance selection system in accordance with an example embodiment.
Figure 8:
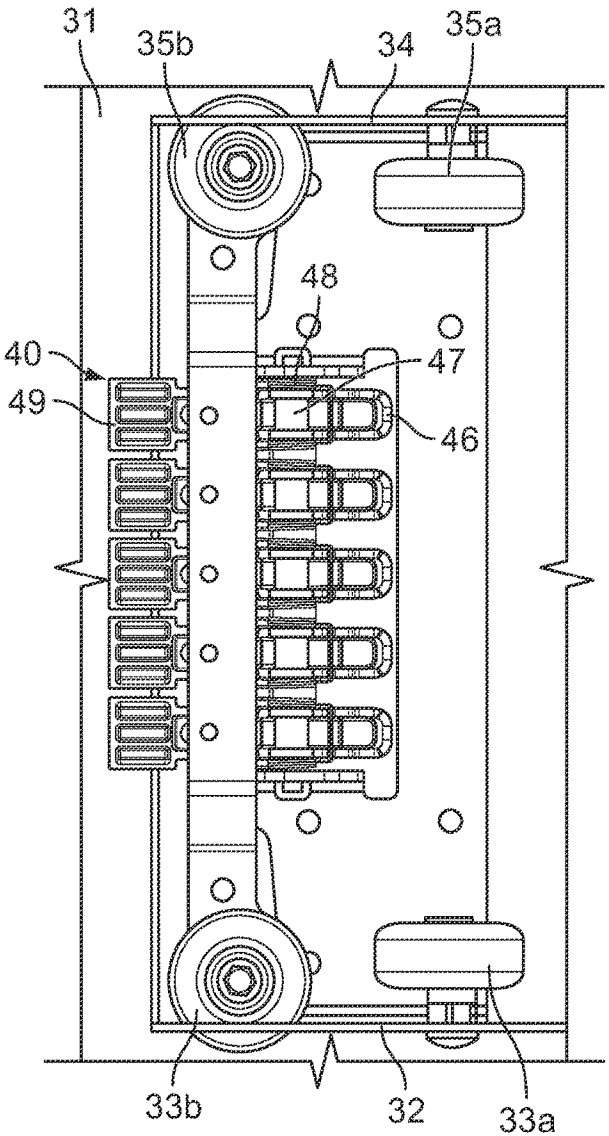
FIG. 8 is a bottom view of a carriage focusing on the catch members of an exercise machine resistance selection system in accordance with an example embodiment.

In the exemplary embodiment best shown in FIGS. 7 and 8, the carriage 30 is illustrated as comprising a plurality of wheels 33*a*, 33*b*, 35*a*, 35*b* which are each adapted to rotate along the first and second rails 20, 25 such that the carriage 30 moves along the first and second rails 20, 25 in one or more directions. More specifically, the carriage 30 may include a plurality of wheels 33*a*, 33*b*, 35*a*, 35*b* which each engage within the respective channels 21, 26 of the rails 20, 25.

As best shown in FIGS. 7 and 8, the carriage 30 may include a first wheel support 32 and a second wheel support 34. In such an exemplary embodiment, the first wheel support 32 extends downwardly from a first side of the carriage 30 and the second wheel support 34 extends downwardly from a second side of the carriage 30. The wheel supports 32, 34 may extend vertically downwardly, or may extend downwardly at an angle (e.g., angled towards or away from the rails 20, 25). Each of the wheel supports 32, 34 may comprise one or more brackets to which one or more wheels 33*a*, 33*b*, 35*a*, 35*b* may be rotatably connected.

In the exemplary embodiment shown in FIG. 7, it can be seen that the carriage 30 includes a first wheel support 32 extending downwardly from a first side of the carriage 30. The first wheel support 32 includes a plurality of wheels 33*a*, 33*b* which are adapted to roll along the first outer channel 21 of the first rail 20. In the exemplary embodiment shown in FIG. 7, it can be seen that the first wheel support 32 includes a combination of both vertical wheels 33*a* and horizontal wheels 33*b*. It should be appreciated that, in some embodiments, only vertical wheels 33*a* or only horizontal wheels 33*b* may be utilized.

The first vertical wheels 33*a* engage with the top or bottom of the first outer channel 21 of the first rail 20. The first horizontal wheels 33*b* engage with the inner side of the first outer channel 21 of the first rail 20. Although not shown, in some embodiments, diagonal wheels may be utilized in combination with or instead of horizontal and/or vertical wheels 33*a*, 33*b*. The figures illustrate an embodiment which includes five vertical wheels 33*a* and two horizontal wheels 33*b*. It should be appreciated that such an embodiment is merely for illustrational purposes, as the first wheel support 32 may include more or less wheels 33*a*, 33*b* than shown in the exemplary figures.

In the exemplary embodiment shown in FIG. 7, it can be seen that the carriage 30 includes a second wheel support 34 extending downwardly from a second side of the carriage 30. The second wheel support 34 includes a plurality of wheels 35*a*, 35*b* which are adapted to roll along the second outer channel 26 of the second rail 25. In the exemplary embodiment shown in FIG. 7, it can be seen that the second wheel support 34 includes a combination of second vertical wheels 35*a* and second horizontal wheels 35*b*. It should be appreciated that, in some embodiments, only vertical wheels 35*a* or only horizontal wheels 35*b* may be utilized.

The second vertical wheels 35*a* engage with the top or bottom of the second outer channel 26 of the second rail 25. The second horizontal wheels 35*b* engage with the inner side of the second outer channel 26 of the second rail 25. Although not shown, in some embodiments, diagonal wheels may be utilized in combination with or instead of horizontal and/or vertical wheels 35*a*, 35*b*. The figures illustrate an embodiment which includes five vertical wheels 35*a* and two horizontal wheels 35*b*. It should be appreciated that such an embodiment is merely for illustrational purposes, as the second wheel support 34 may include more or less wheels 35*a*, 35*b* than shown in the exemplary figures.

D. Resistance Selectors

As shown in FIGS. 3A, 3B, 3C, 3D, 4A, 4B, 4C, 4D, 5, 9, 10A, 10B, 11-14, 15A, 15B, and 16, one or more biasing members 70 may be selectively and removably connected (directly or indirectly) to the carriage 30 so as to impart a variable or fixed resistance force upon movement of the carriage 30 in at least one direction. The manner in which the biasing members 70 are removably connected to the carriage 30 may vary in different embodiments.

In some embodiments, the biasing members 70 may be interconnected with the carriage 30 through use of one or more elongated members 60 such as ropes, cords, strings, threaded members, and other elongated members. In the embodiment shown in the figures, each biasing members 70 is connected to an elongated member 60 which includes an engagement member 66. In such an embodiment, the engagement members 66 may be removably connected to one or more resistance selectors 40 which are connected to the carriage 30.

FIGS. 7 and 8 illustrate a plurality of resistance selectors 40 connected to the underside of a carriage 30. Each of the resistance selectors 40 is illustrated as comprising a first catch member 41 and a second catch member 42, with each of the catch members 41, 42 being distally-spaced apart so as to define a gap between each pair of first and second catch members 41, 42. The number of catch members 41, 42 utilized for each engagement member 66 may vary in different embodiments. Additionally, the distal spacing between each catch member 41, 42, and thus the width of the gap between the catch members 41, 42, may vary in different embodiments.

In the exemplary embodiment shown in the figures, each resistance selector 40 includes a pair of catch members 41, 42 which together are adapted to engage with one engagement member 66. It should be appreciated that, in some embodiments, a single catch member 41 may be utilized to grasp or otherwise engage with the engagement member 66. In other embodiments, three or more catch members 41, 42 may be utilized for the same purpose.

Figure 11:
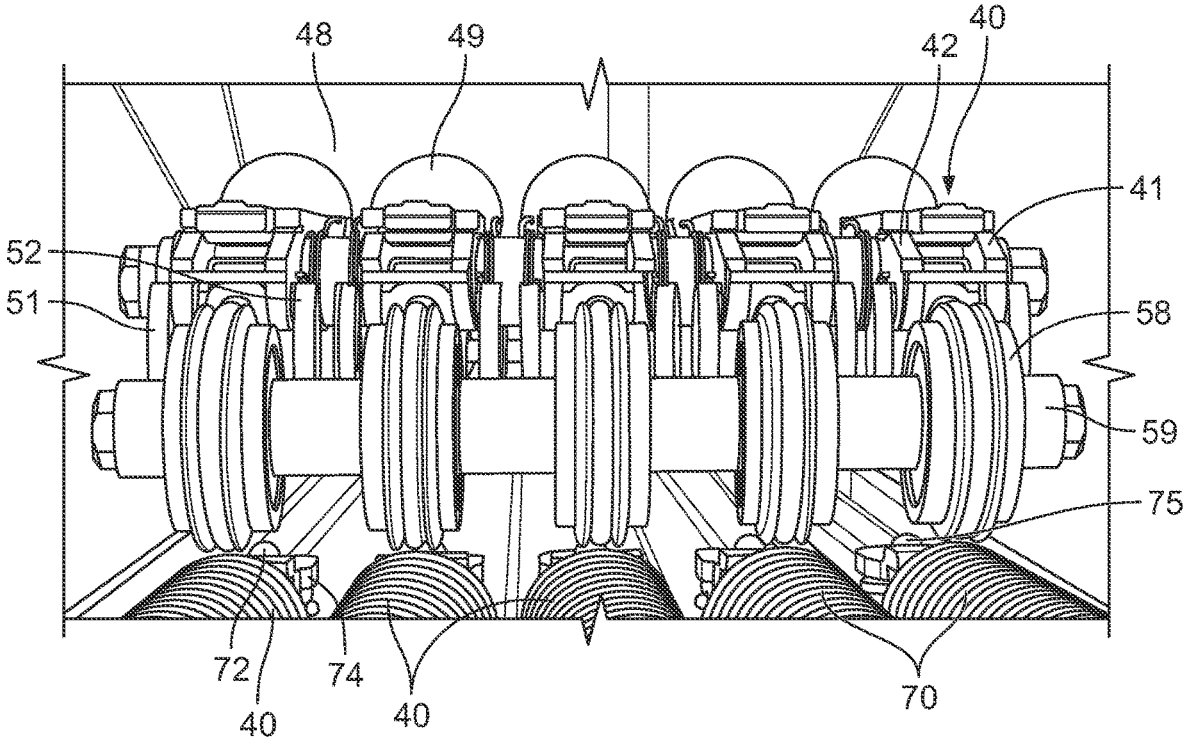
FIG. 11 is a first end view of an exercise machine resistance selection system in accordance with an example embodiment.
Figure 12:
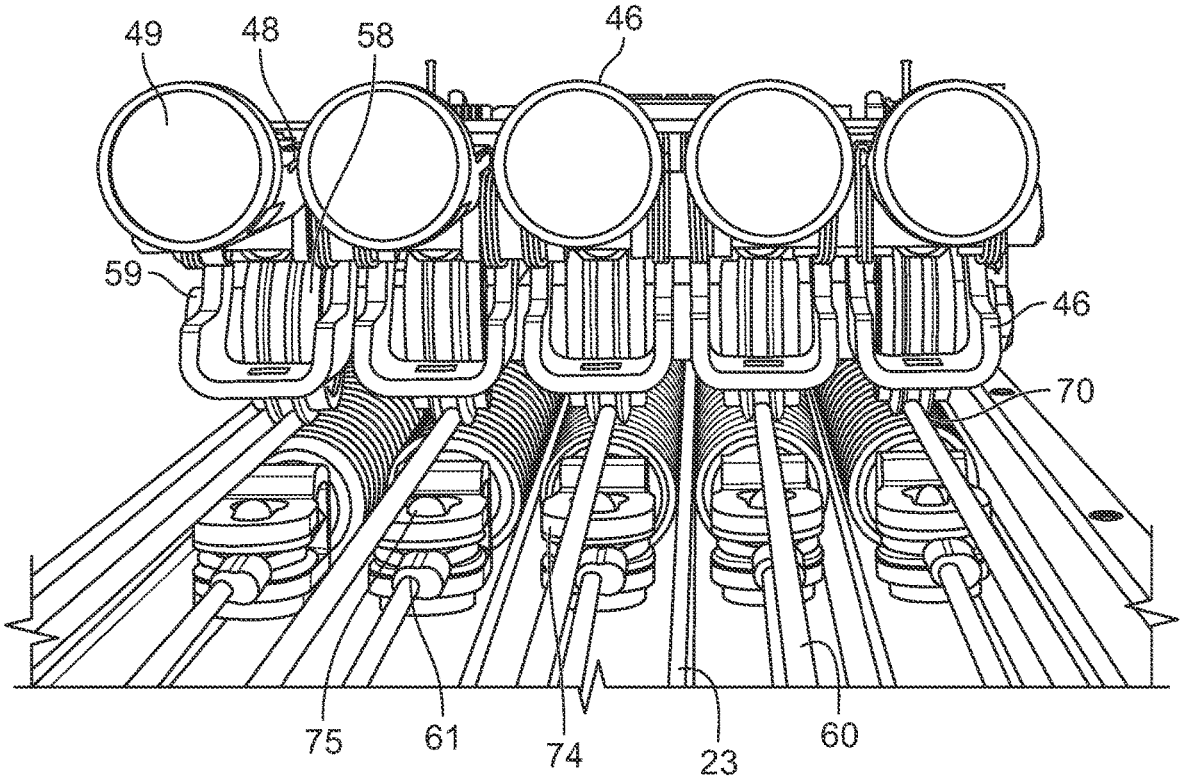
FIG. 12 is a second end view of an exercise machine resistance selection system in accordance with an example embodiment.
Figure 13:
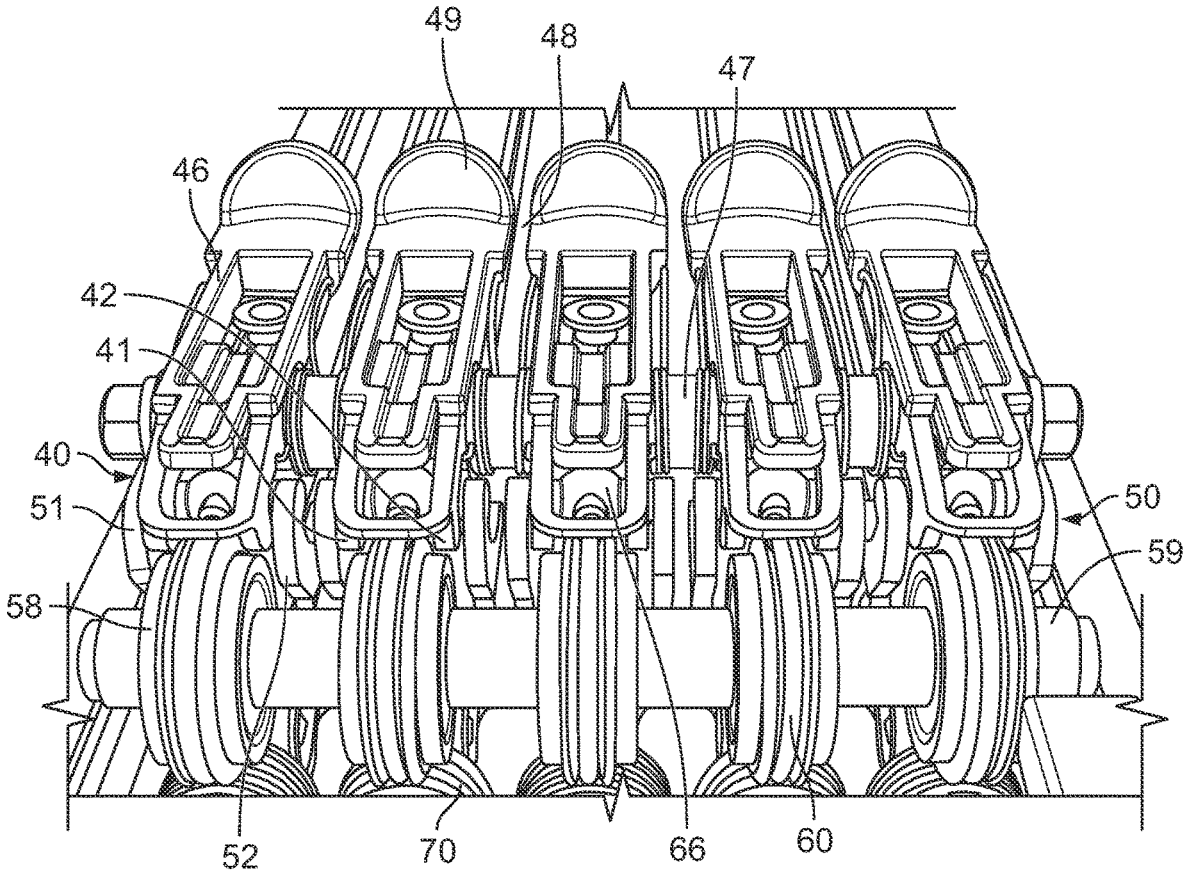
FIG. 13 is a first end perspective view of an exercise machine resistance selection system in accordance with an example embodiment.

The shape of the catch members 41, 42 may vary in different embodiments. In an exemplary embodiment, each of the catch members 41, 42 is comprised of a hook, with the first catch member 41 comprising a first hook and the second catch member 42 comprising a second hook. It should be appreciated, however, that other shapes may be utilized other than a hook, such as but not limited to various types of brackets, loops, magnetic elements, or the like. In the exemplary embodiment shown in the figures, the catch members 41, 42 each include an opening defined within the hook. The respective openings of the catch members 41, 42 may share a concentric axis as shown in FIGS. 11-13.

The resistance selectors 40, each comprising one or more catch members 41, 42, will generally be movably connected to the carriage 30 such that each resistance selector 40 may movably adjust between a first, engaged position and a second, disengaged position. FIGS. 3A, 3B, 4A, and 4B illustrate a pair of catch members 41, 42 in a disengaged position, in which the catch members 41, 42 are oriented parallel to a longitudinal axis extending between the respective front and rear ends of the carriage 30. FIGS. 3C, 3D, 4C, and 4D illustrate a pair of catch members 41, 42 in an engaged position in engagement with an engagement member 66, in which the catch members 41, 42 are oriented transverse (e.g., diagonal, perpendicular) to the same longitudinal axis.

As shown in FIGS. 7 and 8, the resistance selectors 40 may be pivotably connected to the carriage 30. More specifically, it can be seen that each pair of first and second catch members 41, 42 are pivotably connected to the carriage 30 so as to pivot between the engaged position and the disengaged position. An axle 47 is shown extending across the carriage 30 between its respective sides, with each of the resistance selectors 40 being individually pivotably connected to the axle 47 such that each pair of catch members 41, 42 may collectively pivot about the axle 47. Generally, each of the resistance selectors 40 (each comprising one or more catch members 41, 42) will be individually adjustable such that one such resistance selector 40 being pivoted does not cause pivoting of any of the remaining resistance selectors 40.

The manner in which the resistance selectors 40 are connected to the carriage 30 may vary in different embodiments. In the exemplary embodiment shown in the figures, a bracket 45 is shown which connects each of the resistance selectors 40 to the underside of the carriage 30, such as by use of welding, fasteners, adhesives, or the like. As shown in FIG. 7, the bracket 45 may comprise a flat, plate-like member which is connected to the carriage 30 and which includes a plurality of slots to accommodate each of the resistance selectors 40.

It should be appreciated that various other shapes and sizes may be utilized for the bracket 45 in different embodiments. Further, while the figures illustrate a single bracket 45 which connects all of the resistance selectors 40 to the carriage 30, in alternate embodiments, each of the resistance selectors 40 may instead be individually (rather than collectively) connected to the carriage 30. For example, each resistance selector 40 may include its own individual bracket 45. As a further example, each of the resistance selectors 40 may be connected by a fastener, welding, adhesives, or the like to the carriage 30 without use of a bracket 45.

As shown in FIGS. 9-15B, each resistance selector 40 may comprise an arm member 46 which functions as a switch for adjusting the resistance selectors 40 between the engaged and disengaged positions. Each such arm member 46 is generally connected to a resistance selector 40 such that movement of the arm member 46 in a first direction is operable to move the resistance selector 40 towards and into the engaged position and movement of the arm member 46 in a second direction is operable to move the resistance selector 40 towards and into the disengaged position.

While the figures illustrate each arm member 46 being connected to a single resistance selector 40, the resistance selector 40 being comprised of a pair of catch members 41, 42, it should be appreciated that each arm member 46 may be connected to operate more than one resistance selector 40 in some embodiments. For example, in some embodiments, each arm member 46 may be connected to a pair of resistance selectors 40, each of which is comprised of a pair of catch members 41, 42, which are connected to one or more biasing members 70.

In the exemplary embodiment shown in the figures, each arm member 46 is illustrated as being connected to a pair of catch members 41, 42. Pushing each arm member 46 in a forward direction pushes the corresponding pair of catch members 41, 42 to pivot in a forward direction about the axle 47, thus moving the pair of catch members 41, 42 towards and into the engaged position in which the pair of catch members 41, 42 engage with a corresponding engagement member 66. Pulling each arm member 46 in a reverse direction will release the force upon the pair of catch members 41, 42, thus resulting in the pair of catch members 41, 42 pivoting in the reverse direction about the axle 47 and moving towards and into the disengaged position in which the pair of catch members 41, 42 release the corresponding engagement member 66.

In the embodiment best shown in FIGS. 3A-4D, it can be seen that each of the catch members 41, 42 includes a first connector 43*a*. The first connector 43*a* may comprise a projection as shown in the figures, or in different embodiments may comprise an indentation. Similarly, the arm members 46 each include second connectors 43*b*. The second connectors 43*b* may comprise an indentation as shown in the figures, or in different embodiments may comprise a projection. As shown in the figures, the first and second connectors 43*a*, 43*b* will engage with each other when the arm member 46 is pushed forward to engage the catch members 41, 42. In this manner, the arm member 46 may "snap" into place. When the arm member 46 is retracted, the first and second connectors 43*a*, 43*b* disengage.

The manner in which the catch members 41, 42 revert back to their original, disengaged position with movement of the arm member 46 in the reverse direction may vary in different embodiments. In some embodiments, the arm member 46 may be connected to one or more catch members 41, 42 such that movement of the arm member 46 automatically moves the one or more catch members 41, 42. In other embodiments, the arm member 46 may be integrally formed with one or more such catch members 41, 42.

In the exemplary embodiment shown in the figures, the arm member 46 is movably (e.g., slidably) connected to the carriage 30 by the bracket 45. The arm member 46 is positioned adjacent to a corresponding resistance selector 40 comprised of a pair of catch members 41, 42 such that, when the arm member 46 is pushed in a forward direction, it catches onto the pair of catch members 41, 42 and pushes them forward.

The resistance selectors 40 will generally be biased into the disengaged position. Thus, when the arm member 46 is pulled or released in a reverse direction, the force against the pair of catch members 41, 42 is released and the pair of catch members 41, 42 automatically pivot about the axle 47 in the reverse direction towards and into the disengaged position.

The manner in which each resistance selector 40 is biased towards the disengaged position may vary in different embodiments. In the exemplary embodiment shown in FIGS. 3A, 3B, 3C, 3D 4A, 4B, 4C, 4D, and 15B, it can be seen that each resistance selector 40 is connected to a spring 48 which biases the resistance selector 40 towards the disengaged position. More specifically, each pair of catch members 41, 42 is connected to a spring 48 such that, absent the application of force, each pair of catch members 41, 42 will be biased to rotate about the axle 47 in the reverse direction towards and into the disengaged position.

The type of spring 48 utilized may vary in different embodiments. In the exemplary embodiment shown in the figures, a torsion spring 48 is shown being used for each resistance selector 40 (e.g., each pair of catch members 41, 42). However, various other types of springs 48 may be utilized, including but not limited to compression springs, clock springs, tension springs, clips, coil springs, spiral springs, and the like. In other embodiments, the catch members 41, 42 may be comprised of a resilient material which automatically reverts to its original shape or orientation absent force, and thus in such embodiments a separate spring 48 may be omitted.

As best shown in FIGS. 7-15B, each arm member 46 may comprise an elongated member having a handle 49 at a first end thereof. The shape of the handle 49 may vary in different embodiments, with the exemplary embodiment shown in the figures illustrating usage of a round handle 49. Various other shapes, sizes, configuration, and orientations may be utilized. In some embodiments, a separate handle 49 may be omitted, with the arm member 46 instead functioning as a handle 49 itself.

U.S. Pat. No. 10,994,168 discloses an example exercise machine with a resistance selector system, the entire disclosure of which, except for any definitions, disclaimers, disavowals, and inconsistencies, is incorporated herein by reference.

E. Retainers

As best shown in FIGS. 3A-4D, the exercise machine 10 may include one or more retainers 50 which retain the elongated members 60 or biasing members 70 in a resting position when the resistance selectors 40 are disengaged. The retainers 50 will generally comprise fixed structures to which the elongated members 60 or biasing members 70 are connected or held in place when not engaged with a resistance selector 40. The retainers 50 thus prevent the elongated members 60 and biasing members 70 from retracting past the resting point of the carriage 30.

FIGS. 9-16 illustrate a plurality of retainers 50 connected to the frame 19 of an exercise machine 10. More specifically, the retainers 50 may each be connected to the lower member 29 of the frame 19 of the exercise machine 10 such as shown in the figures. Each of the retainers 50 is illustrated as comprising a first retaining member 51 and a second retaining member 52, with each of the retaining members 51, 52 being distally-spaced apart so as to define a gap between each pair of first and second retaining members 51, 52. The number of retaining members 51, 52 utilized for each engagement member 66 may vary in different embodiments. Additionally, the distal spacing between each retaining member 51, 52, and thus the width of the gap between the retaining members 51, 52, may vary in different embodiments.

In the exemplary embodiment shown in the figures, each retainer 50 includes a pair of retaining members 51, 52 which together are adapted to engage with one engagement member 66 when the engagement member 66 is not connected to move with the carriage 30 by being engaged by a resistance selector 40. It should be appreciated that, in some embodiments, a single retaining member 51 may be utilized to retain the engagement member 66. In other embodiments, three or more retaining members 51, 52 may be utilized for the same purpose.

The shape of the retaining members 51, 52 may vary in different embodiments. In an exemplary embodiment, each of the retaining members 51, 52 is comprised of a hook, with the first retaining member 51 comprising a first hook and the second retaining member 52 comprising a second hook. It should be appreciated, however, that other shapes may be utilized other than a hook, such as but not limited to various types of brackets, loops, magnetic elements, or the like. In the exemplary embodiment shown in the figures, the retaining members 51, 52 each include an opening defined within the hook. The respective openings of the retaining members 51, 52 may share a concentric axis.

The retaining members 51, 52 will generally be fixed in their respective positions, and thus will generally not be adjustable or movable (e.g., not able to pivot). The manner by which the retaining members 51, 52 are secured to the frame 19 may vary in different embodiments and should not be construed as limited by the exemplary figures. By way of example, a bracket may connect each of the retainers 50 to the frame 19, such as by use of welding, fasteners, adhesives, or the like. Such a bracket may comprise a flat, plate-like member which is connected to the frame 19 and which includes a plurality of slots to accommodate each of the retainers 50.

In the exemplary embodiment shown in the figures, each of the resistance selectors 40 is oriented downwardly from the underside of the carriage 30, and each of the retainers 50 is oriented upwardly from the frame 19 (e.g., from an upper surface of the lower member 29). Such orientation and positioning of the respective resistance selectors 40 and retainers 50 may vary in different embodiments and should not be construed as limited by the exemplary figures. In some embodiments, the resistance selectors 40 and/or retainers 50 may instead be oriented cross-wise, diagonal, or in other orientations not shown.

In the exemplary embodiment shown in the figures, the resistance selectors 40 fit between and within the retainers 50. More specifically, each of the first and second catch members 41, 42 are positioned so as to extend down between a pair of retaining members 51, 52 when engaged. Thus, the gap between each pair of catch members 41, 42 will generally be narrower than the gap between each pair of retaining members 51, 52. However, the reverse configuration may be utilized in some embodiments, with the catch members 41, 42 instead extending down to surround the retaining members 51, 52.

As shown in the figures, each of the catch members 41, 42 includes an opening 44*a*, 44*b*, and each of the retaining members 51, 52 includes an opening 54*a*, 54*b*. The openings 44*a*, 44*b*, 54*a*, 54*b* may be circular as shown in the figures, or may be other shapes. The respective openings 44*a*, 44*b*, 54*a*, 54*b* may be the same shape and size (e.g., diameter), or may be different shapes and sizes. In the embodiment shown in the figures, the openings 44*a*, 44*b* of the catch members 41, 42 are concentric with the openings 54*a*, 54*b* of the retaining members 51, 52 when the catch members 41, 42 are in the engaged position. Put differently, the openings 44*a*, 44*b* of the catch members 41, 42 may share a concentric axis with the openings 54*a*, 54*b* of the retaining members 51, 52 when the catch members 41, 42 are engaged but not pulled away.

F. Elongated/Biasing Members

As shown in the figures, one or more biasing members 70 may be connected (e.g., directly or indirectly) to the carriage 30 so as to apply a variable or fixed, linear or non-linear force (e.g., a bias/resistance/tension force) to resist movement of the carriage 30 in one or more directions. The one or more biasing members 70 may also provide an equal or non-equal force in the direction of movement of the carriage 30 to assist the movement of the carriage 30 in one or more directions. The biasing members 70 may comprise various devices, assemblies, systems, subsystems, units, and the like capable of imparting a force against an object.

Figure 5A:
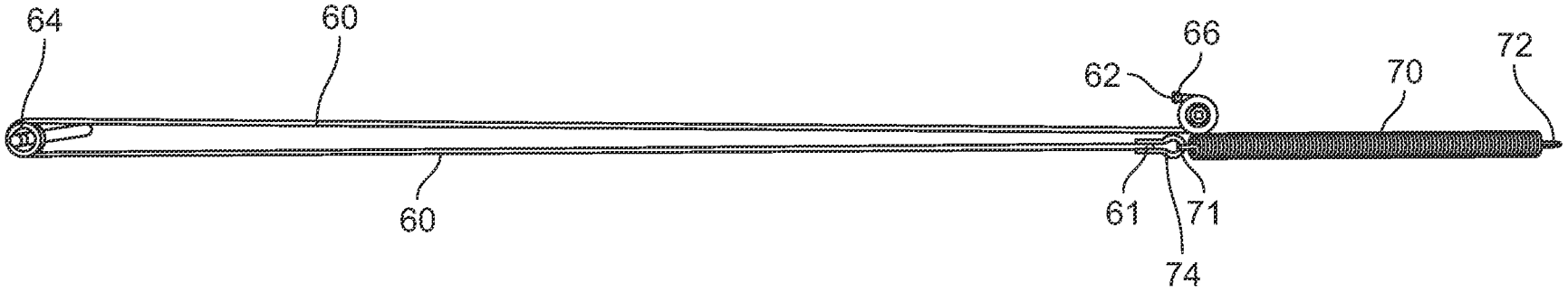
FIG. 5A is a side view illustrating routing of an elongated member and biasing member of an exercise machine resistance selection system in accordance with an example embodiment.
Figure 5B:
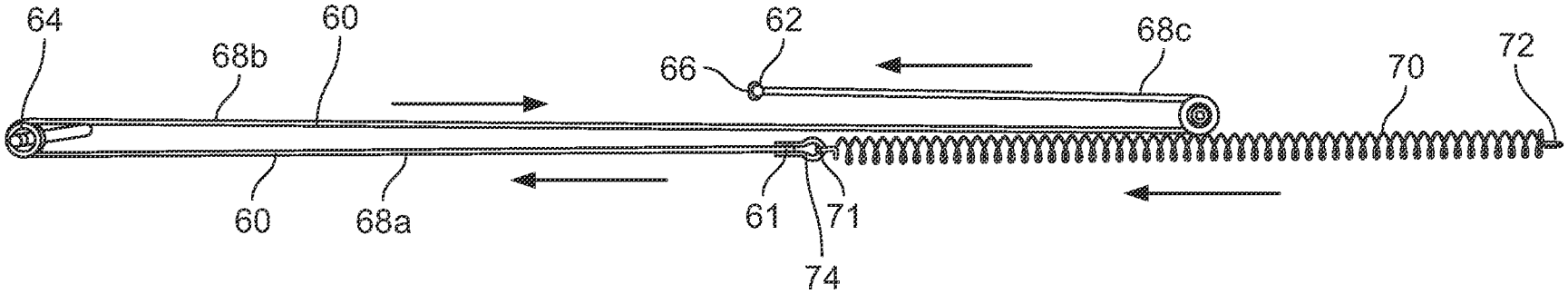
FIG. 5B is a side view illustrating extension of an elongated member and biasing member of an exercise machine resistance selection system in accordance with an example embodiment.

In the embodiment best shown in FIGS. 5A and 5B, it can be seen that the biasing members 70 are indirectly connected to the carriage 30 by use of one or more elongated members 60. More specifically, each elongated member 60, which may be comprised of various configurations including but not limited to ropes, cords, strings, and the like, is wound around one of a plurality of first pulleys 58 and one of a plurality of second pulleys 64. Each elongated member 60 may be selectively and removably connected to the carriage 30 and may be selectively and removably connected to one or more biasing members 70. FIG. 5A illustrates the elongated members 60 and biasing members 70 in a resting position. FIG. 5B illustrates the elongated members 60 and biasing members 70 in an extended position applying a resistance force.

Figure 2C:
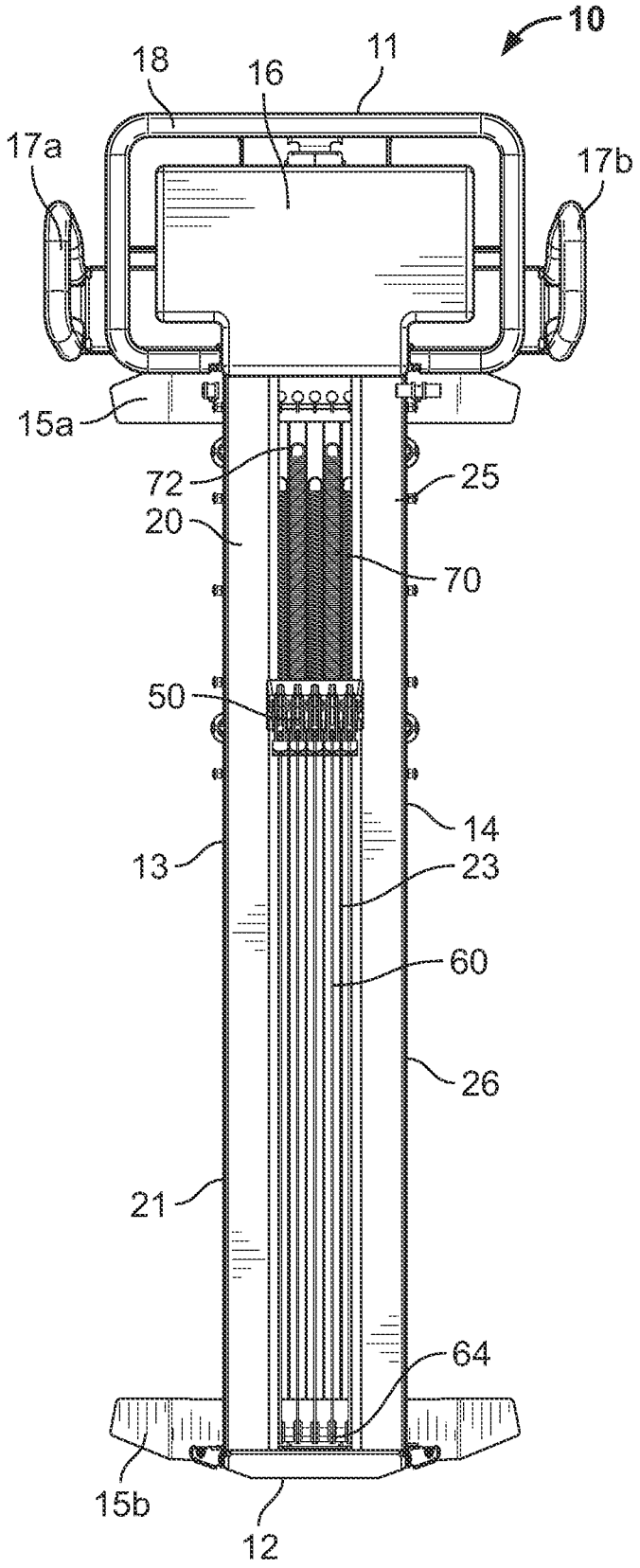
FIG. 2C is a top view of an exercise machine with the carriage removed in accordance with an example embodiment.

In the embodiment shown in the figures, it can be seen that one or more elongated members 60 are wound around a pair of pulleys 58, 64. A first set of pulleys 58 is positioned underneath the resting position of the carriage 30 such that the first set of pulleys 58 is positioned below the upper opening 27. As shown in FIGS. 2B and 2C, the first set of pulleys 58 may thus extend partially out of the upper opening 27. However, in some embodiments, the first set of pulleys 58 may instead be inset with respect to the upper opening 27, with the first set of pulleys 58 not extending out of the top of the upper opening 27.

As shown in FIGS. 10A-13, the first set of pulleys 58 may be connected to rotate about a pulley axle 59. In the exemplary embodiment shown in the figures, a single pulley axle 59 is shown, with each of the first set of pulleys 58 rotatably connected around the pulley axle 59 such that each of the first set of pulleys 58 is individually rotatable about the pulley axle 59. In some embodiments, each of the first set of pulleys 58 may have its own pulley axle 59.

In the exemplary figures, a second set of pulleys 64 is shown positioned near the first end 11 of the exercise machine 10, with the elongated members 60 being wound around both the first set of pulleys 58 underneath the upper opening 27 and the second set of pulleys 64 at the first end 11 of the exercise machine 10.

A plurality of biasing members 70 are shown positioned adjacent to the elongated members 60, with the biasing members 70 being positioned between the carriage 30 and the second end 12 of the exercise machine 10. In some embodiments, each of the elongated members 60 may be selectively and removably engaged with one or more of the biasing members 70 and to the carriage 30 (e.g., to the resistance selectors 40 of the carriage 30) such that variable levels of resistance may be applied against movement of the carriage 30 in one or more directions.

As best shown in FIGS. 5A and 5B, each of the elongated members 60 is comprised of a first end 61 and a second end 62. The first end 61 of each of the elongated members 60 is connected to a bracket 74, with the bracket 74 being connected to a biasing member 70. Thus, each bracket 74 is connected between an elongated member 60 and a biasing member 70 so as to connect the elongated member 60 to the biasing member 70. In this manner, resistance force from the biasing member 70 will be imparted against extension of the elongated member 70 as discussed in more detail below.

The manner in which the first end 61 of each elongated member 60 is connected to the bracket 74 may vary in different embodiments. In an exemplary embodiment as shown in the figures, the first end 61 of each elongated member 60 may include a loop, with a pin 75 being inserted through both the bracket 74 and the loop of the elongated member 60 to secure the first end 61 of the elongated member 60 to the bracket 74.

In some embodiments, brackets 74 may be omitted entirely. In such embodiments, each elongated member 60 may instead be directly connected to a biasing member 70. In other embodiments, elongated members 60 may be omitted, with the biasing members 70 each being directly, selectively connected to the carriage 30 so as to impart a resistance force against movement of the carriage 30 in at least one direction.

Figure 14:
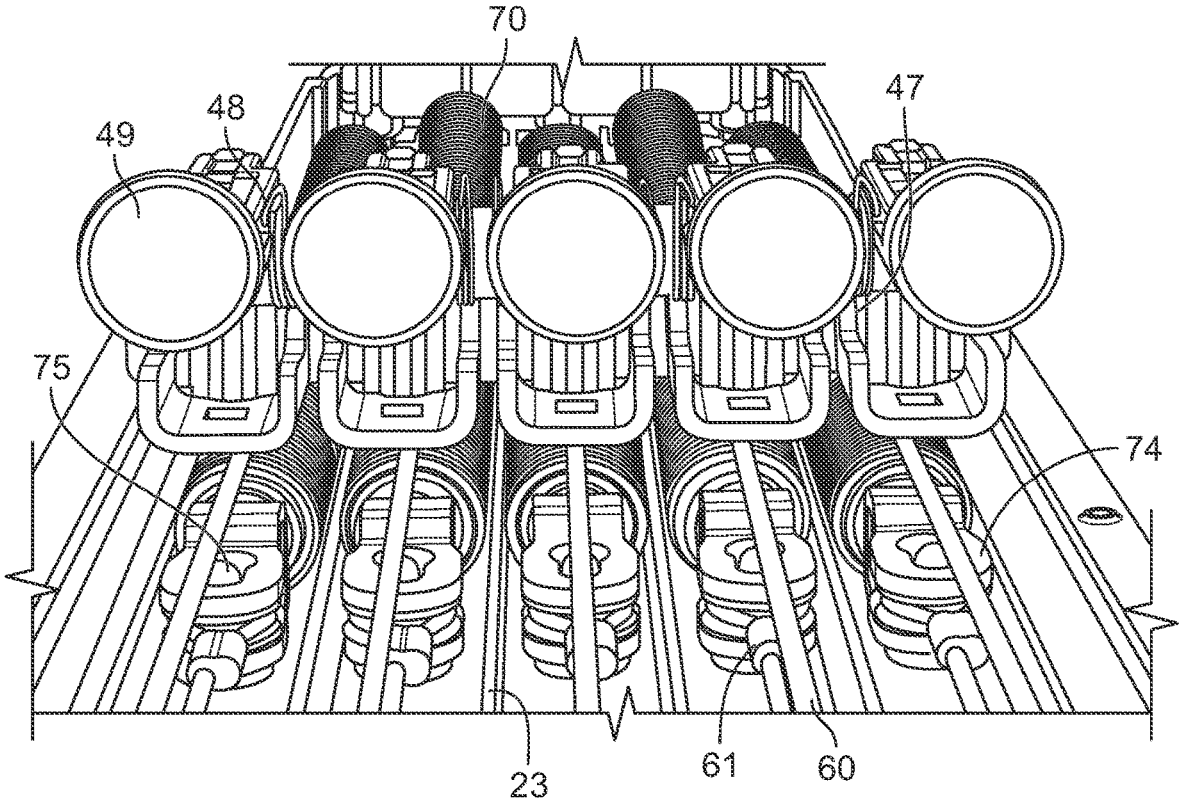
FIG. 14 is a second end perspective view of an exercise machine resistance selection system in accordance with an example embodiment.
Figure 15A:
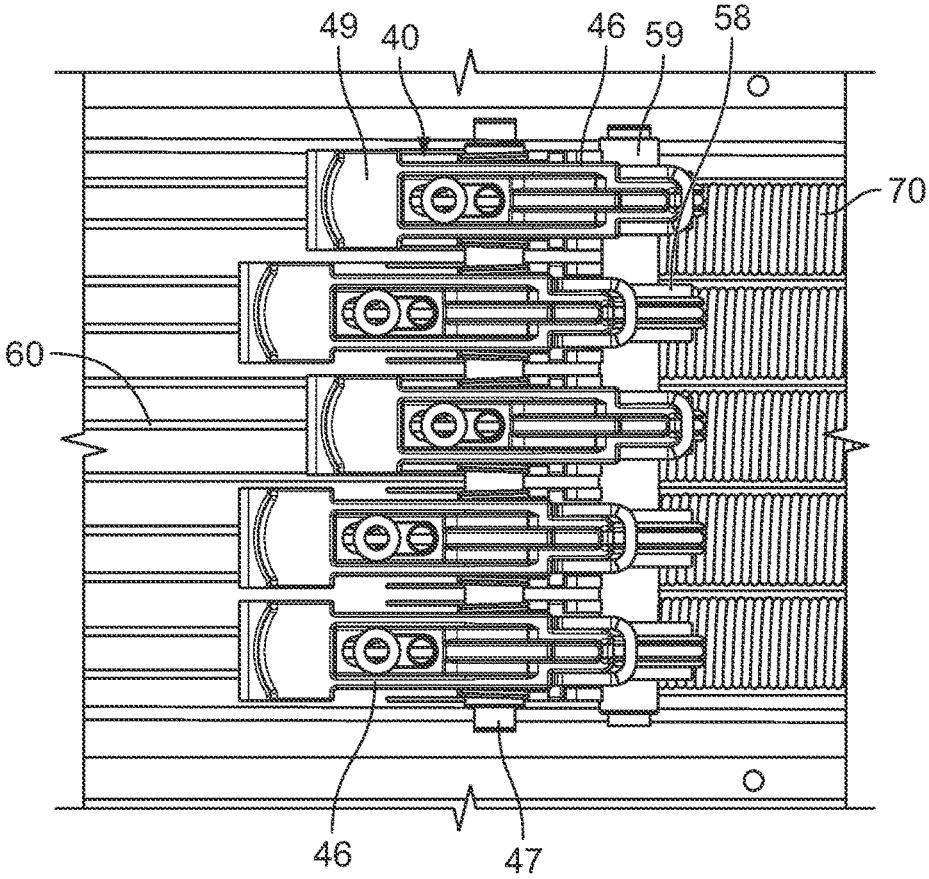
FIG. 15A is a bottom view of an exercise machine resistance selection system in which a pair of catch members is in the engaged position in accordance with an example embodiment.
Figure 15B:
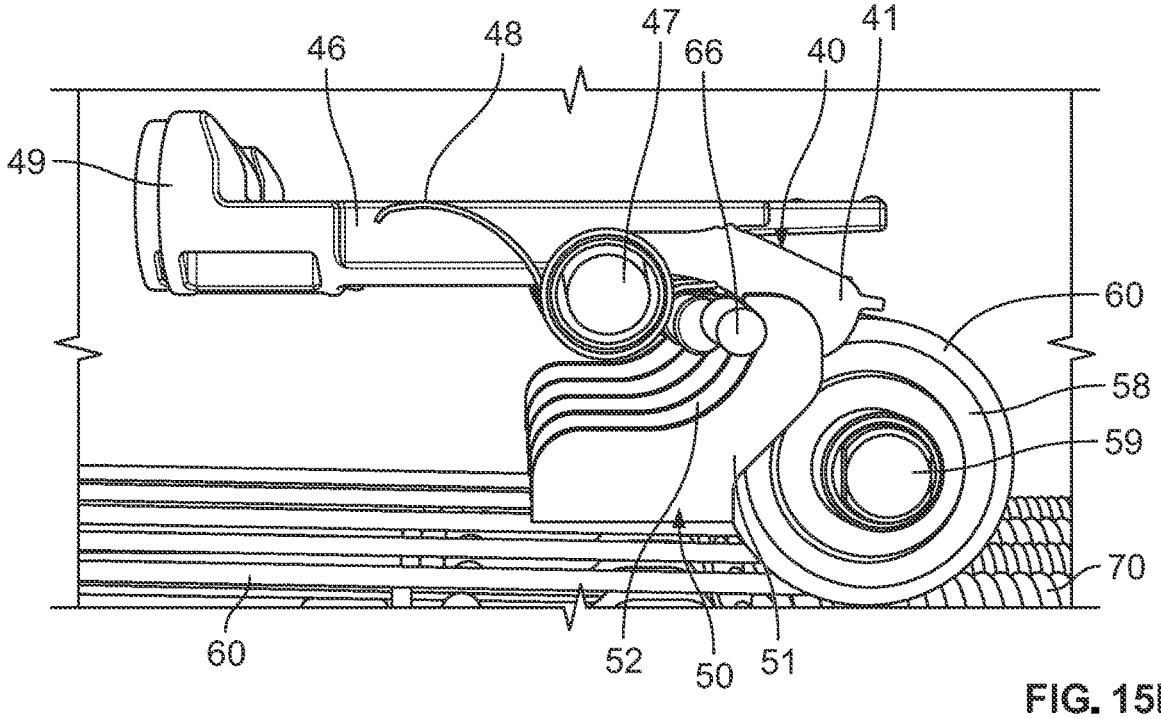
FIG. 15B is a side perspective view of an exercise machine resistance selection system in which a pair of catch members is in the engaged position in accordance with an example embodiment.
Figure 16:
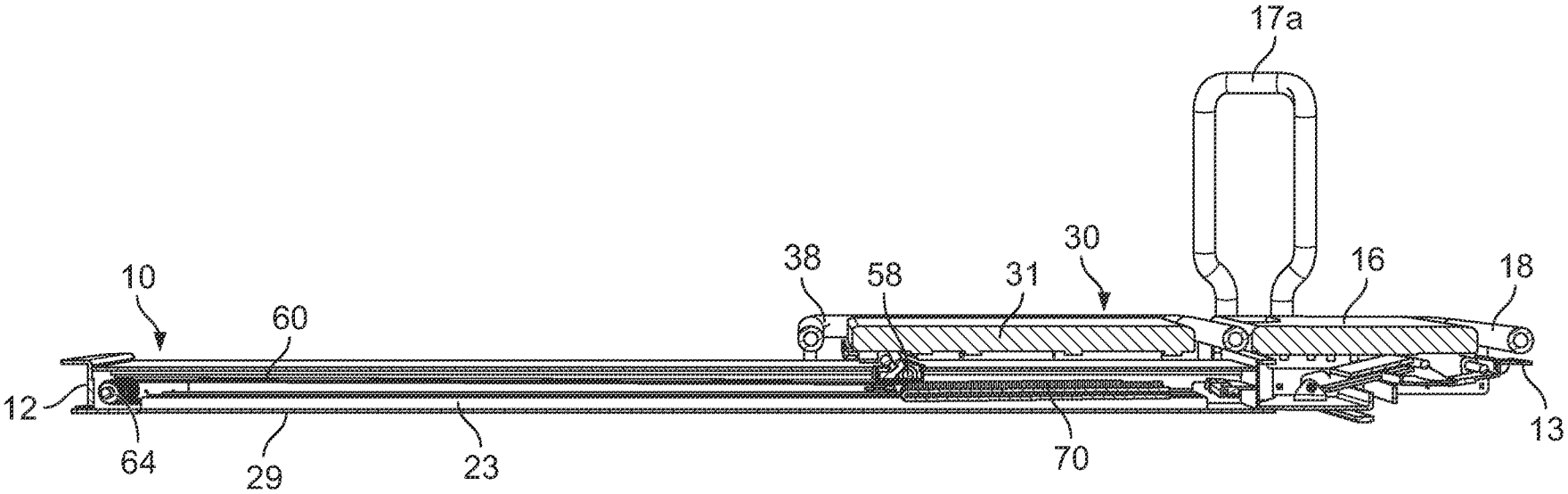
FIG. 16 is a sectional view taken along line 14-14 of FIG. 2A.

As shown in FIGS. 11, 12, and 14, each elongated member 60 may extend from the bracket 74 towards the first end 11 of the exercise machine 10, where each elongated member 60 is wound around a corresponding pulley 58 to then reverse direction back towards the carriage 30. The elongated members 60 may each then be positioned over a second pulley 64 underneath the carriage 30 such as shown in FIGS. 5 and 16.

As best shown in FIGS. 5A and 5B, each elongated member 60 may be arranged to have three distinct runs 68*a*, 68*b*, 68*c*. A first run 68*a* of the elongated member 60 extends between the biasing member 70 and the second pulley 64. A second run 68*b* of the elongated member 60 extends between the second pulley 64 and the first pulley 58. The third run 68*c* of the elongated member 60 extends between the first pulley 58 and either the retainer 50 (when disengaged) or the resistance selector 40 (when engaged). Thus, the first pulley 58 functions as a transition point between the second and third runs 68*b*, 68*c*, and the second pulley 64 functions as a transition point between the first and second runs 68*a*, 68*b* as shown in FIGS. 5A and 5B.

Figure 3A:
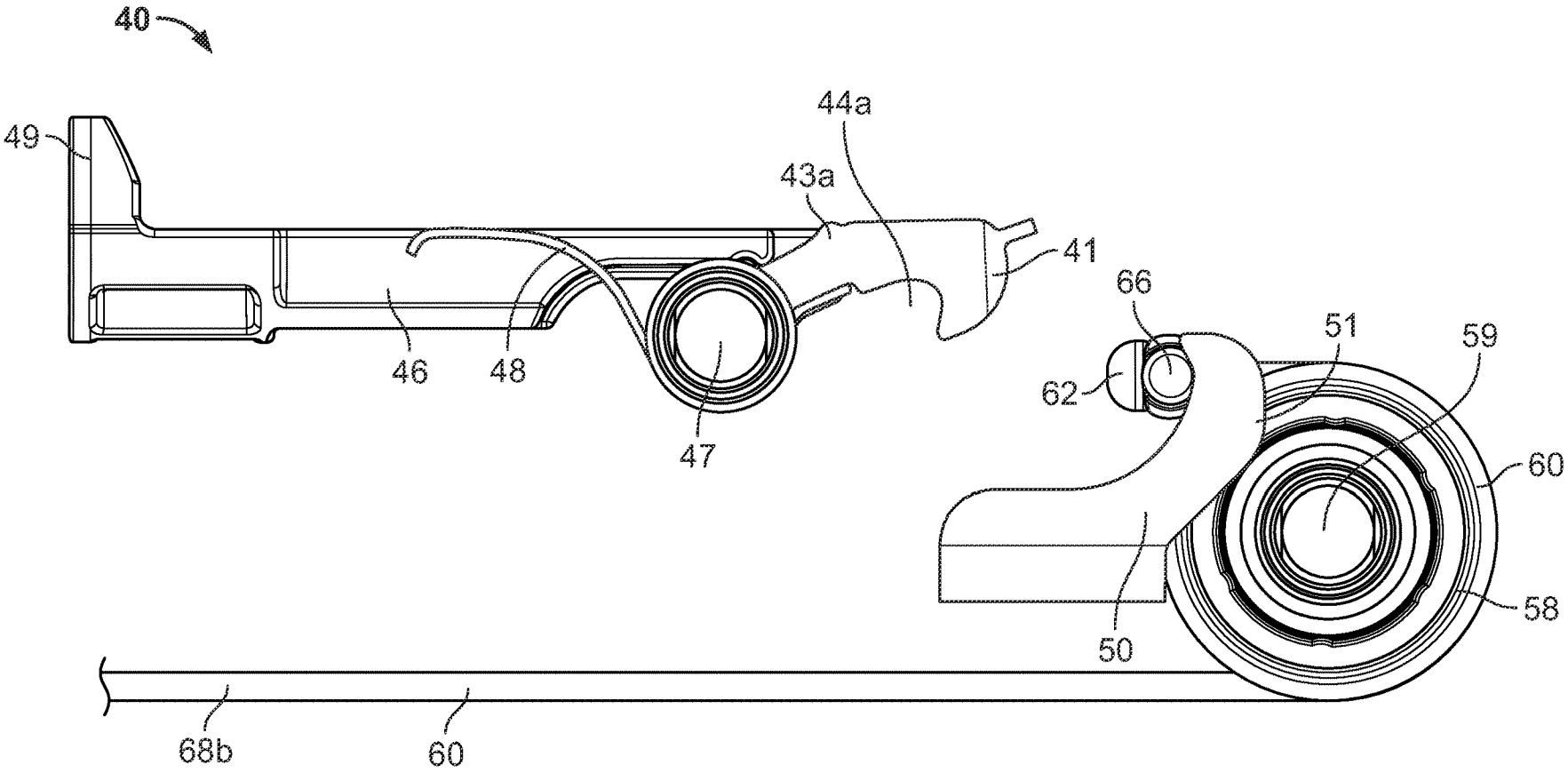
FIG. 3A is a side view of an exercise machine resistance selection system with the catch member in a disengaged position and pulled away in accordance with an example embodiment.

Each elongated member 60 will generally include an engagement member 66 at its second end 62. The engagement member 66 may comprise a cylindrical member, clasp, hook, loop, or other structure which is adapted to removably and selectively engage within the resistance selector 40. In the embodiment shown in the figures, the engagement member 66 is crosswise (i.e., perpendicular) to the elongated member 60 to which it is attached. It should be appreciated that, in some embodiments, the engagement member 66 may instead be diagonally-oriented. It should also be appreciated that, in some embodiments, the engagement member 66 may comprise a knob or other structure adapted to engage within the resistance selectors 40. In some embodiments, the second end 62 of each elongated member 60 may include its own knob which connects the second end 62 of each elongated member 60 to its engagement member 66 such as shown in FIG. 3A.

Each of the biasing members 70 is generally connected between one or more of the elongated members 60 at its first end 71 and the frame 19 at its second end 62. Thus, as shown in FIG. 5A, the first end 71 of each biasing member 70 may be connected either directly to an elongated member 60, or to a bracket 74 that is itself connected to an elongated member 60. The second end 72 of each biasing member 70 is generally connected to the frame 19. The second end 72 of each biasing member 70 may be connected to the frame 19 using various methods, such as but not limited to fasteners 63, adhesives, magnets, clasps, brackets, and the like.

Figure 9:
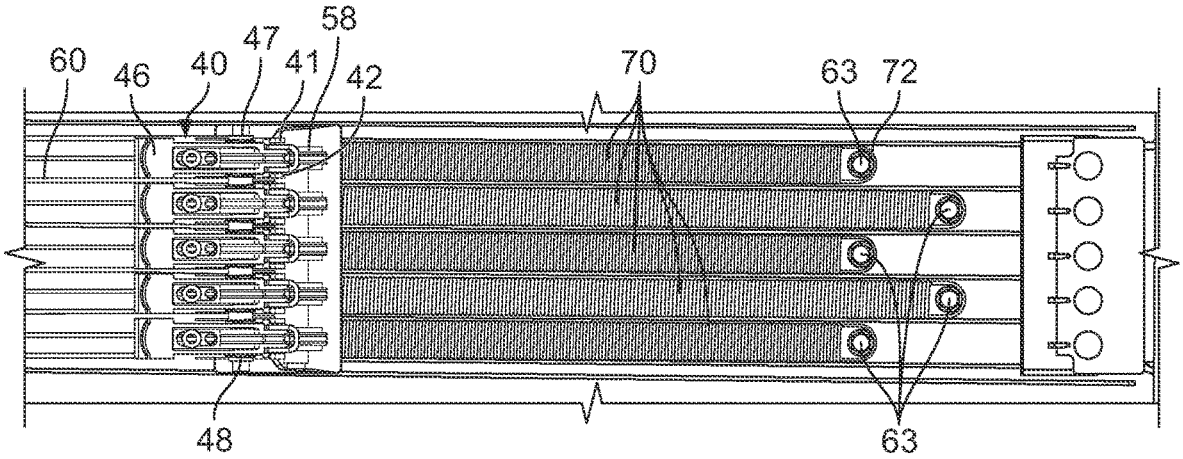
FIG. 9 is a bottom view of an exercise machine resistance selection system in accordance with an example embodiment.
Figure 10A:
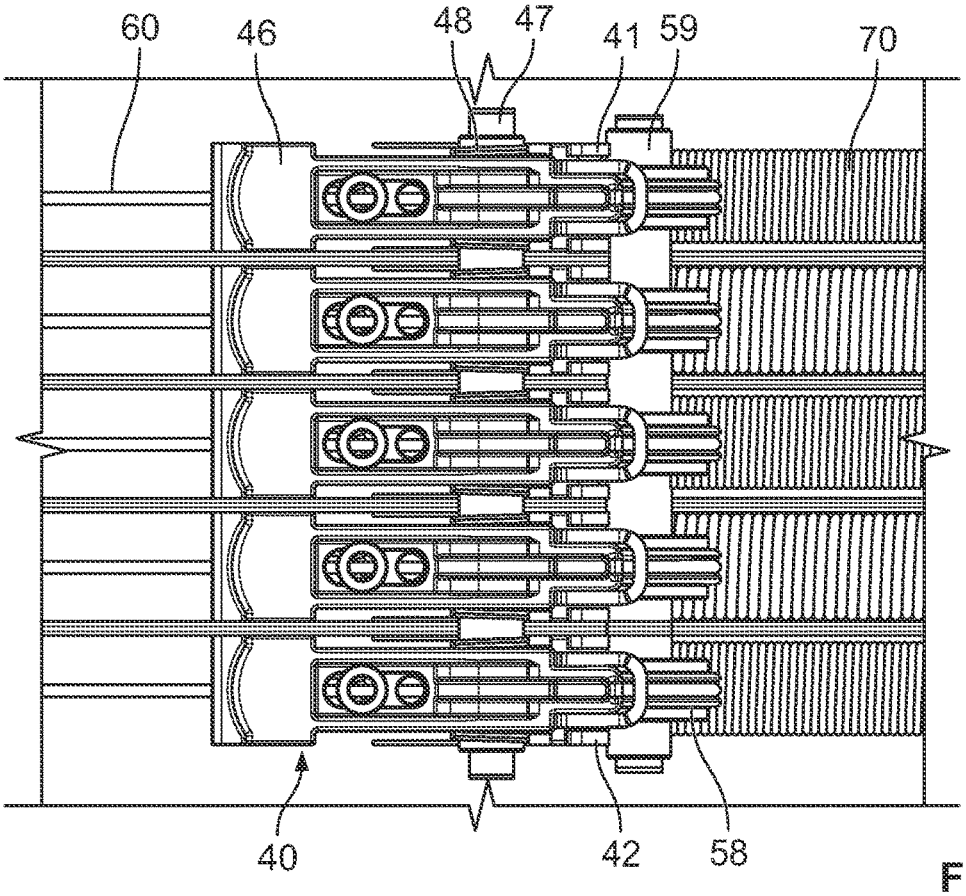
FIG. 10A is a bottom view of an exercise machine resistance selection system focusing on the catch members in accordance with an example embodiment.
Figure 10B:
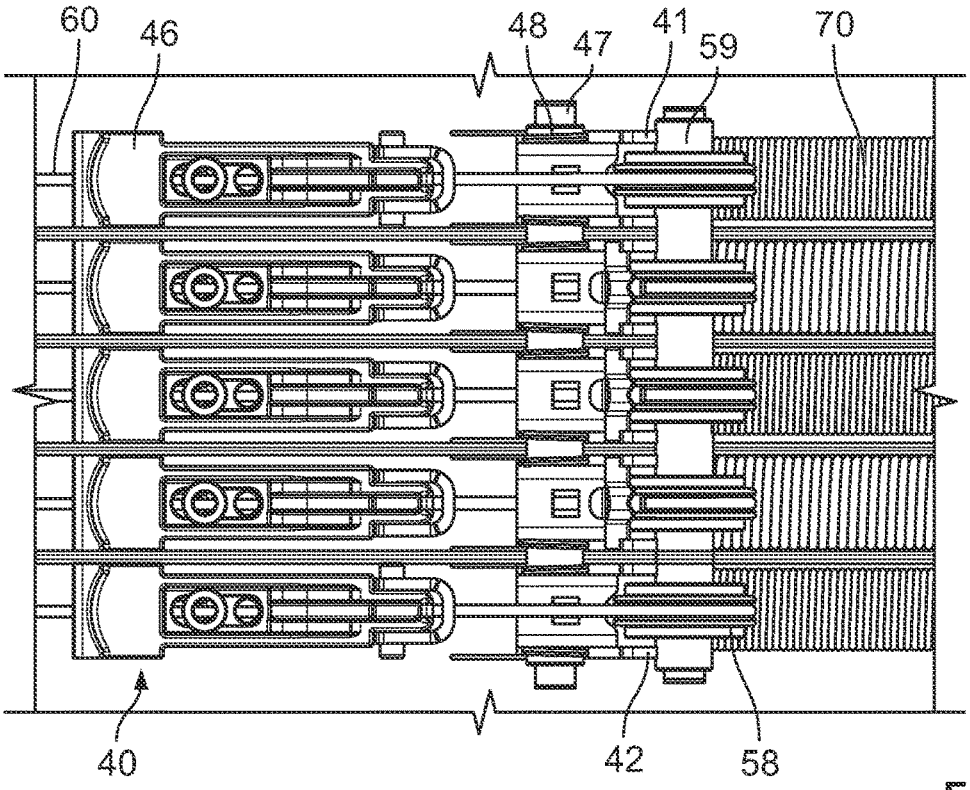
FIG. 10B is a bottom view of an exercise machine resistance selection system with a pair of catch members in the engaged position and pulled away in accordance with an example embodiment.

In the exemplary embodiment shown in FIG. 9, it can be seen that fasteners 63 such as pins are utilized to anchor the respective second ends 72 of the biasing members 70 to the frame 19. Thus, the second end 72 of each biasing member 70 connected to the frame 19 by a fastener 63 will stay fixed to the frame 19 as the first end 71 of each biasing member 70, which is engaged by a resistance selector 40, is pulled away when the carriage 30 is moved, thus stretching the biasing member 70 as shown in FIG. 5B.

It should be appreciated that the number of elongated members 60 and/or biasing members 70 may vary in different embodiments. In the exemplary embodiment shown in the figures, it can be seen that five elongated members 60 are illustrated, with each of the five elongated members 60 being connected by a bracket 74 to one or five biasing members 70. However, more or less elongated members 60 and/or biasing members 70 may be utilized. For example, more or less than five elongated members 60 may be utilized. Additionally, the number of biasing members 70 to which each such elongated member 60 is connected may vary. While the figures illustrate that each elongated member 60 is connected to a single biasing member 70, in some embodiments, each elongated member 60 may be connected to two or more biasing members 70. Conversely, each biasing member 70 may be connected to two or more elongated members 60 in different embodiments.

The biasing force applied by each of the biasing members 70 may be a linear force or a non-linear force. The total force applied to the carriage 30 by each of the biasing members 70 may be adjusted by the number of biasing members 70 connected to the carriage 30 being changed. The connection of more biasing members 70 will increase the total force applied to the carriage 30, and the connection of less biasing members 70 will decrease the total force applied to the carriage 30. Thus, by connecting additional biasing members 70 to the carriage 30, the total force applied to the carriage 30 will increase. By removing biasing members 70 from the carriage 30, the total force applied to the carriage 30 will decrease.

Each biasing member 70 may provide a constant force or a variable force to the carriage 30. Each of the biasing members 70 may also provide the same force or a different force to the carriage 30. Each of the one or more biasing members 70 may be configured to provide the same force, with each biasing member 70 providing a uniform force. Thus, each of the biasing members 70 may be comprised of the same size, same type, same length, and same force (e.g., 5 pounds force in a resting position and 10 pounds force in a stretched position). Each biasing member 70 may be comprised of one or more elongated elastic objects such as utilizing two tension coil springs together to form a single biasing member 70.

Alternatively, the one or more biasing members 70 may be configured to each provide a different force, with one or more of the biasing members 70 providing a different force than one of more of the other biasing members 70. In some embodiments, multiple biasing members 70 may provide the same force, while other biasing members 70 may provide a different force than the remaining biasing members 70. As an example, a first biasing member 70 may be comprised of a tension coil spring having an initial tension force of 3 pounds and a stretched tension force of 5 pounds and a second biasing member 70 may be comprised of a tension coil spring having an initial tension force of 6 pounds and a stretched tension force of 10 pounds, which allows for incremental adjustment of the tension force applied to the carriage 30. As a further example, a third biasing member 70 may have a different force compared to the first and second biasing members 70. In some embodiments, the amount of force for each of the biasing members 70 may be indicated by various indicia, such as by color-coding, illumination, tactile feedback, audible sounds, or the use of visual indicia such as symbols and/or text.

By way of a further example, a first biasing member 70 may be adapted to apply 1 pound of force, a second biasing member 70 may be adapted to apply 5 pounds of force, a third biasing member 70 may be adapted to apply 15 pounds of force, and a fourth biasing member 70 may be adapted to apply 20 pounds of force. By connecting the first and third biasing member 70 to the carriage 30, the total force applied to the carriage 30 will be 16 pounds. As a further example, connecting the second and fourth biasing members 70 to the carriage 30 will result in a total force of 25 pounds being applied to the carriage 30. Various other combinations may be utilized, and thus the preceding exemplary illustrations should not be construed as limiting in scope.

Generally, the amount of force applied to the carriage 30 (e.g., the amount of bias force experienced by the carriage 30) will be a function of the inherent characteristics of the biasing member 70 being utilized. For example, such inherent characteristics may include, without limitation, the type, material, length, diameter, pitch, number of winds, spring constant, frequency of compression, etc. of the particular biasing members 70 being utilized. Further, the amount of force applied to the carriage 30 will depend upon the length of the connected biasing members 70, the motion of the biasing members 70, and the number of biasing members 70 connected to the carriage 30 at a particular time.

If each of the biasing members 70 has the same inherent characteristics, then the connection of ten biasing members 70 to the carriage 30 will generate ten times the amount of force as if only one biasing member 70 was connected. If each of the biasing members 70 has different inherent characteristics, then the force can be adjusted by connecting different combinations of biasing members 70 to the carriage 30. Thus, there are large variations in force that can be applied to the carriage 30 by modifying a variety of variables including the number of connected biasing members 70.

The biasing member 70 may comprise one or more connected components providing a mechanism for creating a preferred force of an exercise machine 10 against which an exerciser must generally apply a muscle force greater than the biasing member 70 force in order to move a component (e.g., the carriage 30) in a direction opposed to the direction of the force.

The type of biasing member 70 utilized may vary in different embodiments, including but not limited to electronic resistance devices, magnetic resistance devices, electromagnetic resistance devices, electric motor resistance devices (e.g., a motor such as a servo motor or stepped motor), various types of springs (e.g. linear springs, non-linear springs, coil springs, tension springs, compression springs, spring tethers, extension springs, torsion springs, metal springs, non-metal springs, etc.), various types of elastic members (e.g. elastic bands, rubber bands, resistance bands, elastic shock cords, elastomer members, viscous members, resistance tubes), various weights, dashpots, eddy current breaks, friction blocks, pneumatic members, and/or any other member/device/system capable of creating linear or non-linear forces upon the carriage 30.

Each of the biasing members 70 may be comprised of a linkage member (e.g. elongated member, cable, rope, arm, cord, wire, bar, etc.) that is connected to and transfers a force from a resistance device such as but not limited to a magnetic resistance device, electrical-mechanical resistance device, electromagnetic resistance device, electronic resistance device, electric motor resistance device, fan-based resistance device, fluid-based resistance device, mechanical resistance device, or direct contact resistance device. Any such linkage member may be rigid, flexible, elastic, resilient, etc. The resistance device may provide a constant force, a variable force or a user-selected adjustable force that is transferred to the carriage 30.

Any of the aforementioned types of biasing members 70 may be connected to a cable or linkage that redirects a force of one or more resistance-inducing components to a movable component (e.g., the carriage 30) used by an exerciser for performing an exercise against the resistance.

In some embodiments, the one or more biasing members 70 may be permanently affixed to the carriage 30. In other embodiments, one or more biasing members 70 may be removably and selectively attached to the carriage 30 such that a variable level of force may be applied to movement of the carriage 30 upon the first and second rails 20, 25 depending on the number of such biasing members 70 attached.

The one or more biasing members 70 may each have a first end attached to a fixed component of the exercise machine 10 and a second end that is adapted for selectively connecting to a movable component of the exercise machine 10 (e.g., the carriage 30), thereby allowing for adjustment of the force applied to the movable component of the exercise machine 10. The second end of the one or more biasing members 70 is opposite of the first end of the one or more biasing members 70. Each of the biasing members 70 may have various cross-sectional shapes (e.g., circular, square-shaped, etc.) and various initial contracted lengths (e.g., 3 feet, 4 feet, etc.).

In some embodiments in which the biasing members 70 are directly connected to the carriage 30, the exercise machine 10 may include one or more biasing members 70 which are connected to the carriage 30 so as to provide a force against movement of the carriage 30 in at least a first direction and in favor of movement of the carriage 30 in at least a second direction opposite to the first direction. Generally, the first end of each biasing member 70 will be anchored, such as by being coupled with the exercise machine 10 (e.g., to a structural element of the frame 19), with the second end of each biasing member 70 being removably and selectively coupled to the carriage 30, such as by use of a resistance selector device or manually by hand.

In embodiments such as shown in the figures, a first end of each biasing member 70 may be anchored to the exercise machine 10, and a second end of each biasing member 70 may be selectively and removably connected to one or more of the elongated members 60 so as to impart resistance force against movement of the carriage 30. However, various structures and methods may be utilized to selectively and removably connect one or more of the biasing members 70 directly to the carriage 30, including but not limited to the use of magnets, latches, clamps, clasps, fasteners, adhesives, and the like.

G. End Platform

As shown in FIGS. 1-2C and 17, the exercise machine 10 may include one or more end platforms 16 on which various portions of an exerciser's body may be positioned while performing various types of exercise movements. The figures illustrate the use of a single end platform 16 positioned at or near a second end 12 of the exercise machine 10. In some embodiments, the first end 11 of the exercise machine 10 may also include an end platform 16. The exercise machine 10 may thus not have any end platforms, or the exercise machine 10 may have one end platform 16 such as shown in the figures, or the exercise machine 10 may have a pair of end platforms 16.

The shape, orientation, size, and positioning of the end platform 16 may vary in different embodiments. The end platform 16 will generally include a first end and a second end. The first end of the end platform 16 will generally face towards the carriage 30 and the second end of the end platform 16 will generally face away from the carriage 30.

The manner in which the end platform 16 is connected to the exercise machine 10 may vary. The end platform 16 may be connected directly to the frame 19, or form a part of the frame 19, of the exercise machine 10. The end platform 16 may be connected to one or more of the rails 20, 25. The end platform 16 may include various cutouts or gripping surfaces which an exerciser may contact with various body parts during performance of various exercise moves. The end platform 16 may include one or more handles 17*a*, 17*b*, 18 to aid in performing various exercise moves, or to aid in mounting or dismounting the exercise machine 10.

In the exemplary embodiment shown in the figures, the end platform 16 is illustrated as including a perimeter handle 18 which substantially surrounds the end platform 16 as best shown in FIGS. 1-2C and 17. The perimeter handle 18 is distally-spaced with respect to the outer edges of the end platform 16 so as to define a gap or opening in which an exercise may place various body parts during performance of various exercise movements. Additionally, the embodiment shown in FIGS. 1-2C and 17 illustrates that the end platform 16 includes a pair of side handles 17*a*, 17*b* which extend upwardly from the end platform 16 on either side of the end platform 16. Thus, a first side handle 17*a* extends upwardly from a first side of the end platform 16 and a second side handle 17*b* extends upwardly from a second side of the end platform 16. Various other handle configurations may be utilized for the end platform 16, or the end platform 16 may not include handles at all, in some embodiments.

H. Operation of Preferred Embodiment

In use, an exerciser will generally approach the exercise machine 10 and select a level of resistance force to be applied against movement of the carriage 30 along the at least one rail 20, 25. Exercise routines will widely vary among exercisers, and the exercise machine 10 is configured to accommodate a wide range of exercise styles. For example, some exercisers may prefer to ramp up their workout during the routine, starting at a lower level of resistance and then working up to a greater level of resistance. Other exercisers may prefer a more intensive routine which starts at a high level of resistance and stays there. Yet other exercisers may prefer a more intensive beginning, followed by a cooling off period with less resistance.

Generally, an exerciser will first approach the exercise machine 10 and decide the initial level of resistance to set. In some situations, an exerciser may prefer to perform some initial exercise moves without any resistance at all. In those cases, the exerciser may perform exercise moves using the exercise machine 10, such as but not limited to moving the carriage 30, without any resistance force applied.

When desired, the exerciser may choose to connect one or more biasing members 70 to the carriage 30 such that the biasing members 70 apply a resistance force against movement of the carriage 30 in one or more directions. Using the resistance selectors 40, the exerciser may initially set any number of biasing members 70 to apply resistance force against movement of the carriage 30.

To "activate" a biasing member 70, the exerciser will generally adjust the desired arm members 46 into an engaged position. The manner in which an exerciser adjusts the arm members 46 may vary in different embodiments. In one exemplary embodiment, an exerciser will push the arm member 46 forward. In some embodiments, the exerciser may grasp the handle 49 (if included) and, using the handle 49, push the arm member 46 forward. In other embodiments, the arm member 46 may instead be pulled, or moved pivotably or to the side, to engage the arm member 46.

In the embodiment shown in the figures, the exerciser will push the arm member 46 in a forward direction towards the carriage 30. The arm member 46 will thus push the catch members 41, 42 such that the catch members 41, 42 pivot about the axle 47 in a forward direction to engage with the engagement member 66. As previously mentioned, the engagement member 66 may be directly connected to a biasing member 70, or may be connected to an elongated member 66 which is itself connected to a biasing member 70.

Figure 3B:
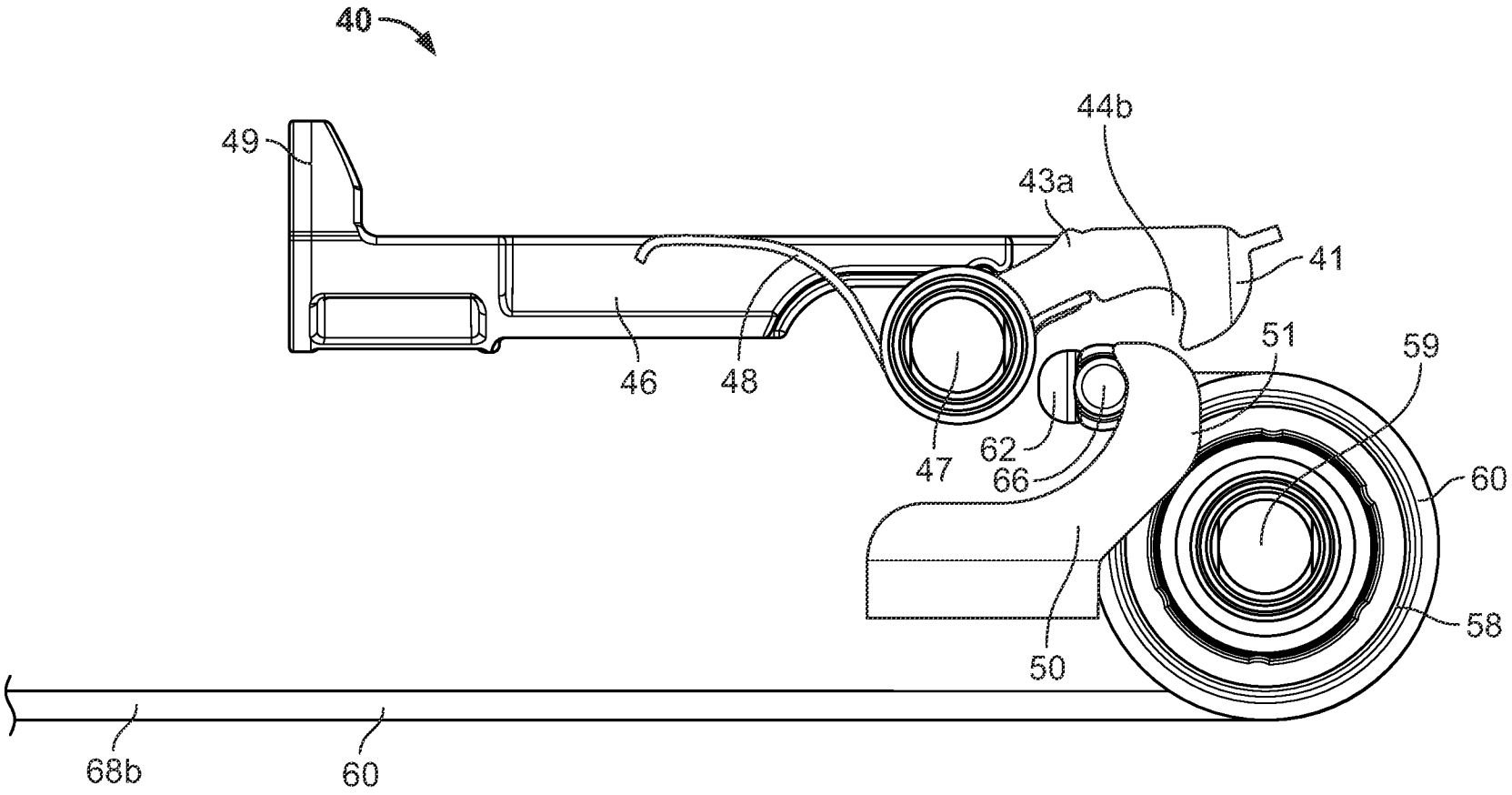
FIG. 3B is a side view of an exercise machine resistance selection system with the catch member in a disengaged position in accordance with an example embodiment.
Figure 4A:
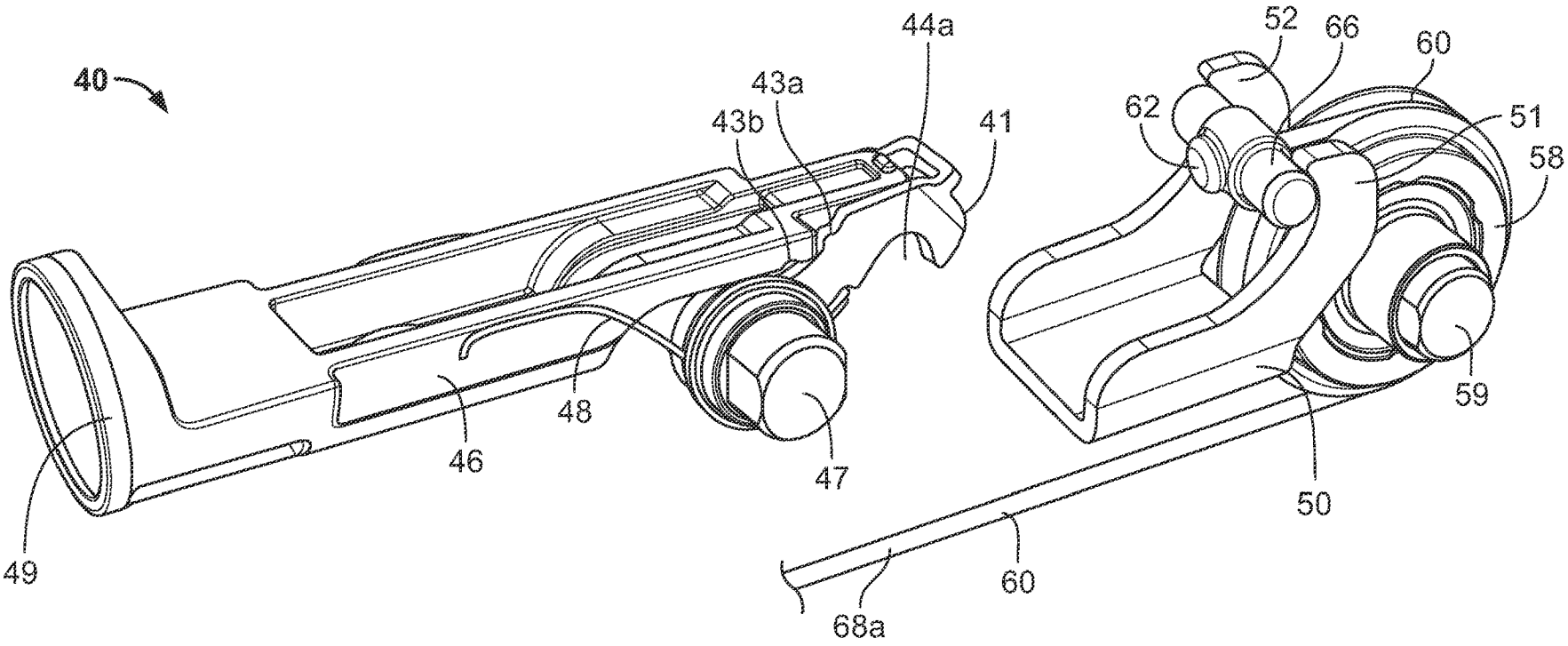
FIG. 4A is a perspective view of an exercise machine resistance selection system with the catch member in a disengaged position and pulled away in accordance with an example embodiment.
Figure 4B:
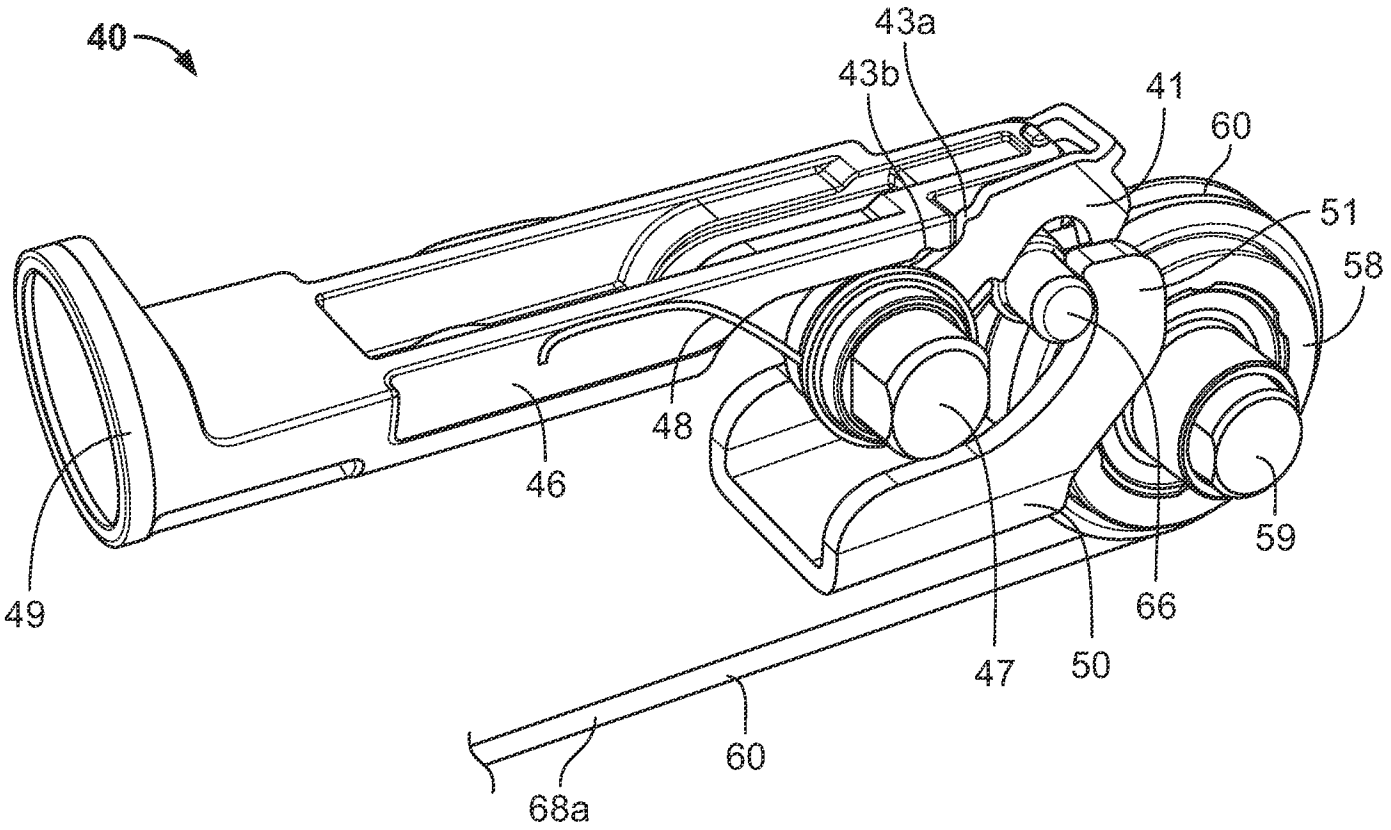
FIG. 4B is a perspective view of an exercise machine resistance selection system with the catch member in a disengaged position and pulled away in accordance with an example embodiment.

As the catch members 41, 42 pivot in a forward direction, the openings 44*a*, 44*b* of the catch members 41, 42 will surround the engagement member 66 so as to engage the engagement member 66 within the catch members 41, 42. The catch members 41, 42 will generally fit between the pair of retaining members 51, 52 which retain the engagement member 66 when not engaged by the catch members 41, 42. The arm member 46 may snap into place when engaged, and will generally stay in the engaged position until pulled or otherwise disengaged. FIGS. 3A, 3B, 4A, and 4B illustrate catch members 41, 42 in the disengaged position, with the engagement member 66 shown being retained by the retaining members 51, 52. FIGS. 3A and 4A illustrate the disengaged catch members 41, 42 having been pulled away from the retaining members 51, 52. FIGS. 3B and 4B illustrate the disengaged catch members 41, 42 in position above the retaining members 51, 52.

Figure 3C:
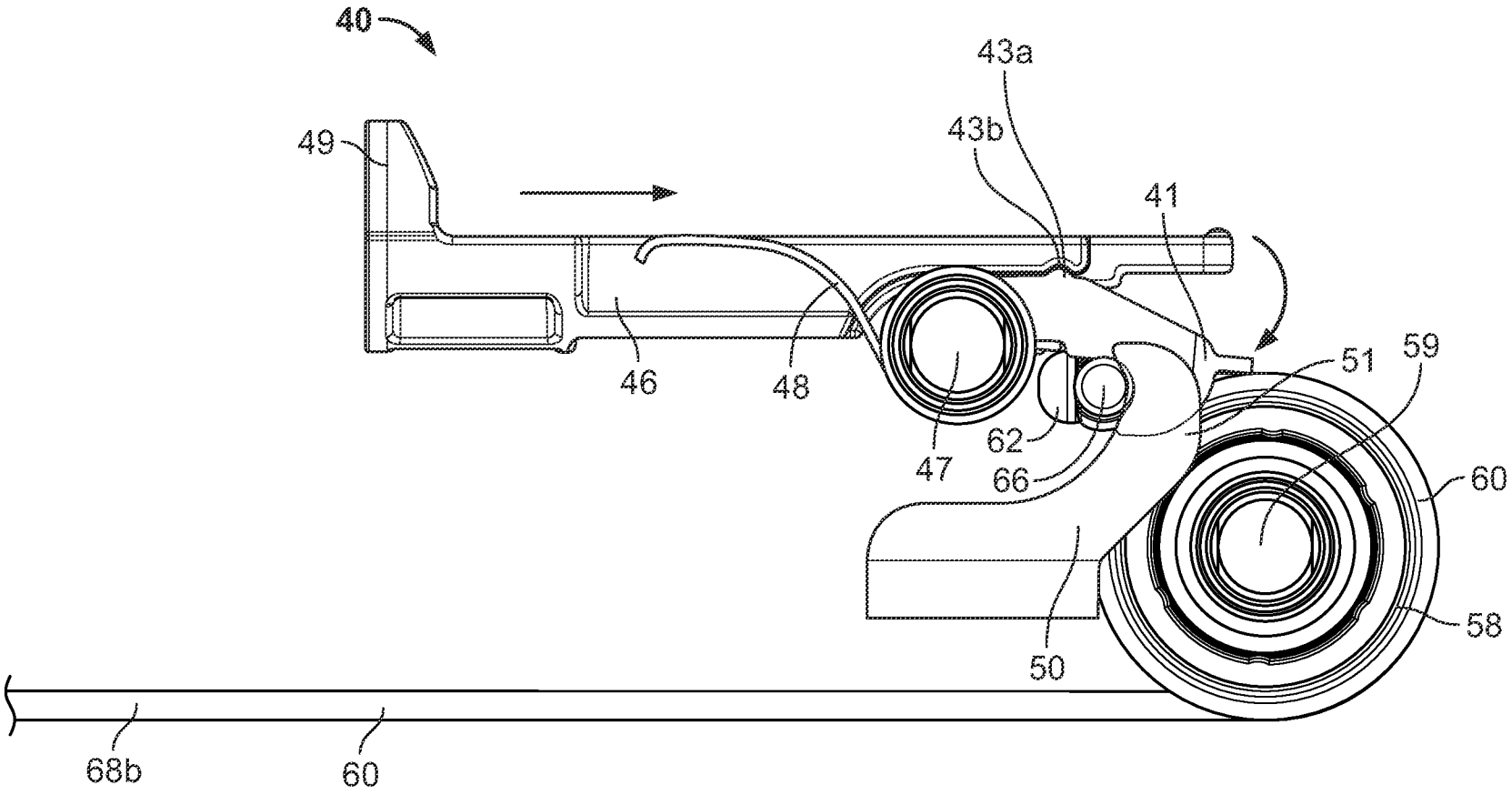
FIG. 3C is a side view of an exercise machine resistance selection system with the catch member in an engaged position but not pulled away in accordance with an example embodiment.
Figure 4C:
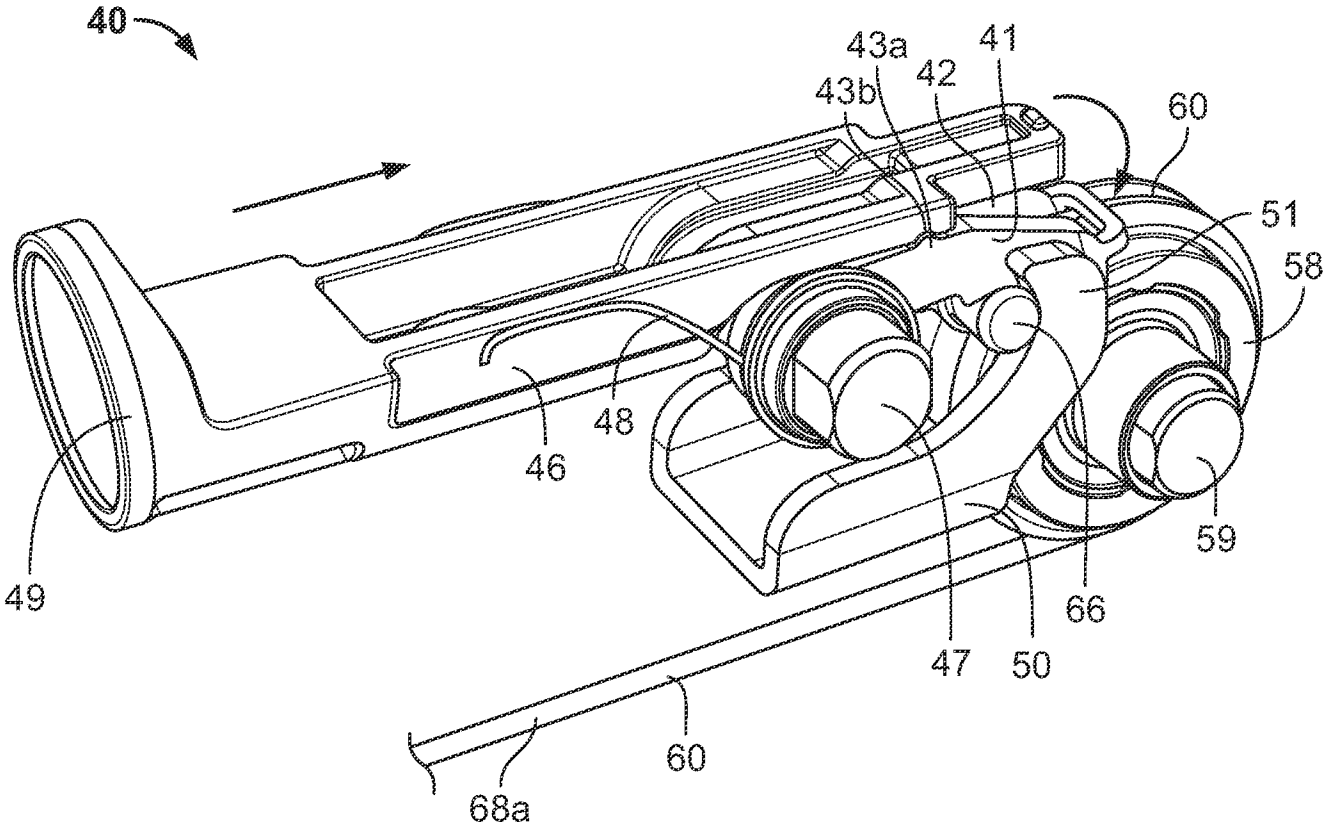
FIG. 4C is a perspective view of an exercise machine resistance selection system with the catch member in an engaged position but not pulled away in accordance with an example embodiment.

FIGS. 3C and 4C illustrate catch members 41, 42 engaged with the engagement member 66, but not yet pulled away (i.e., the catch members 41, 42 are engaged but the carriage 30 has not yet been moved). In such a position, the catch members 41, 42 will be positioned between the first and second retaining members 51, 52. Additionally, the openings 44*a*, 44*b* of the catch members 41, 42 will be concentric with the openings 54*a*, 54*b* of the retaining members 51, 52.

Figure 3D:
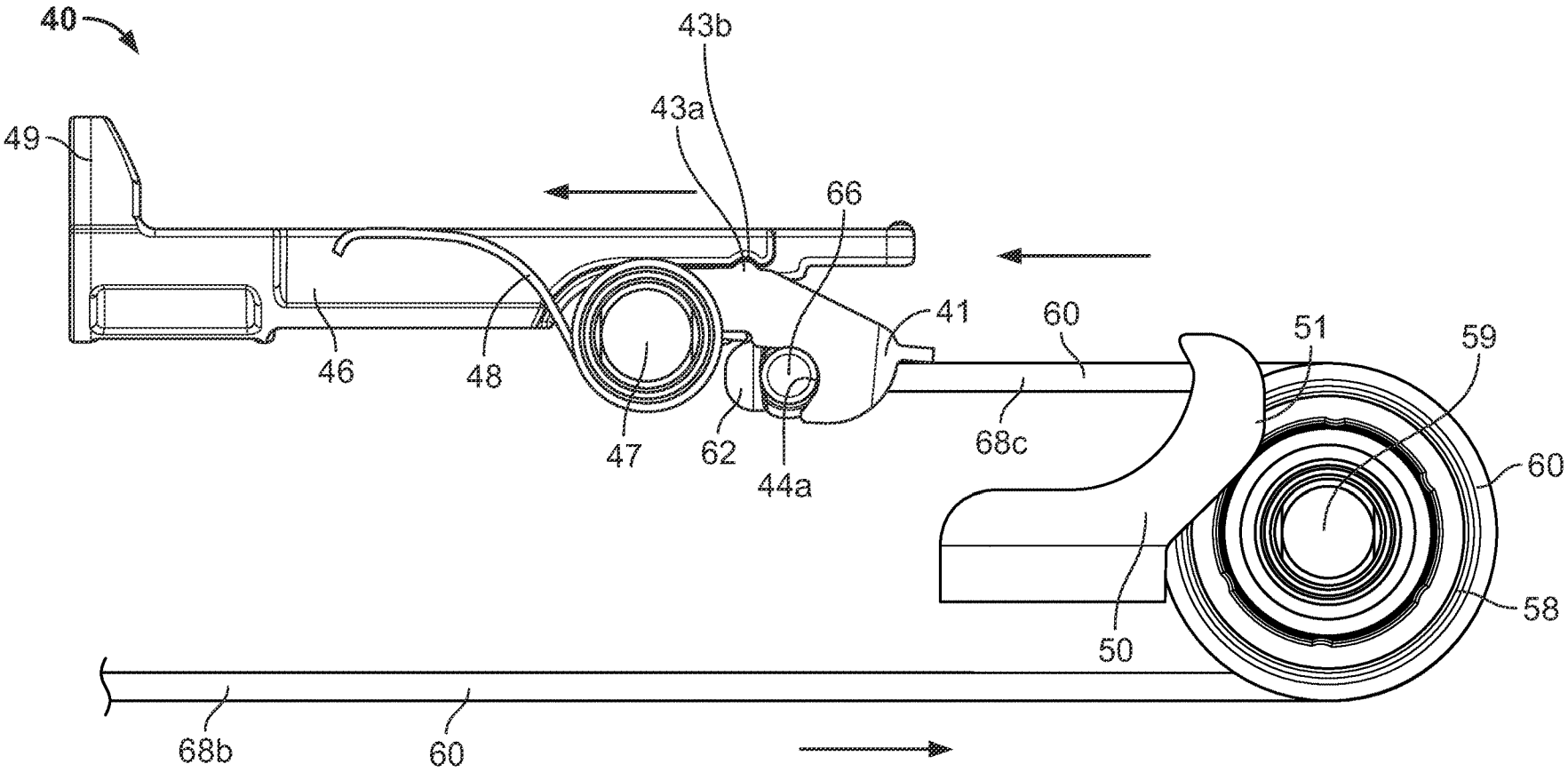
FIG. 3D is a side view of an exercise machine resistance selection system with the catch member in an engaged position and pulled away in accordance with an example embodiment.
Figure 4D:
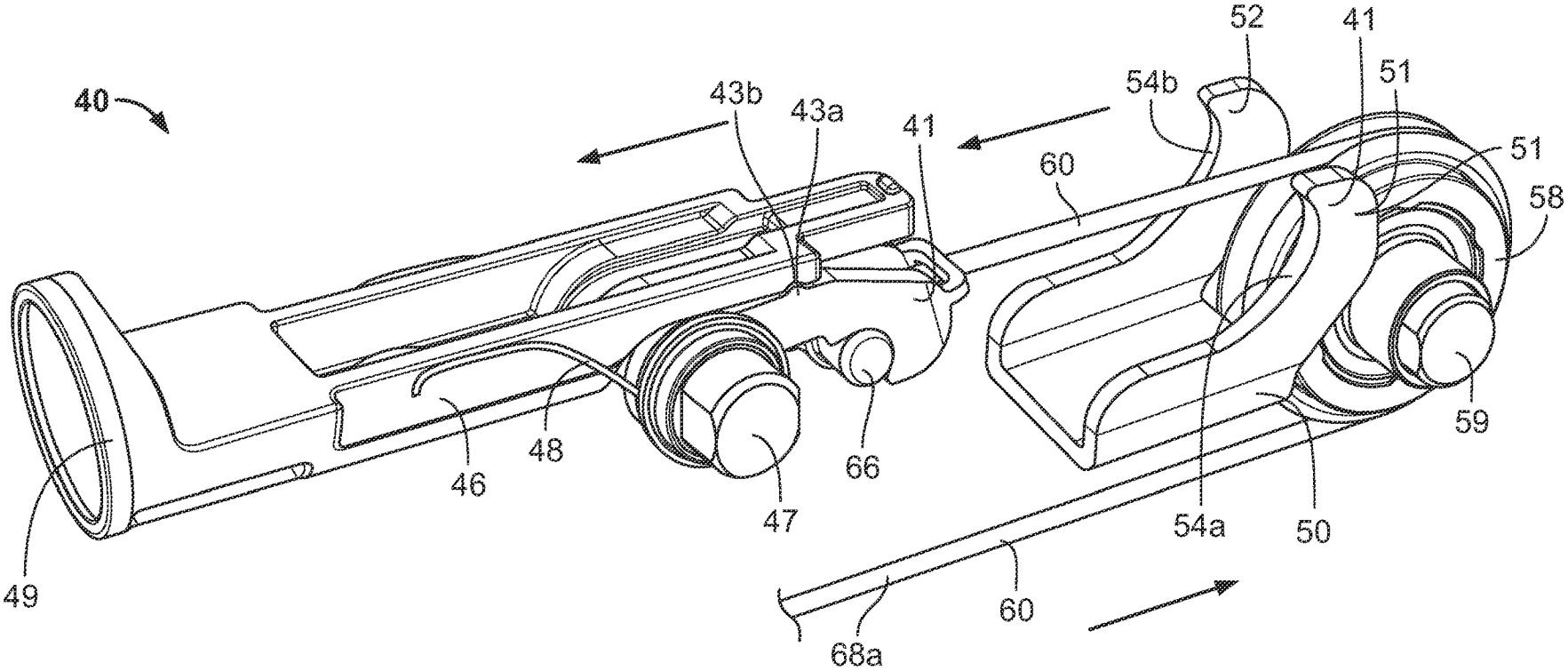
FIG. 4D is a perspective view of an exercise machine resistance selection system with the catch member in an engaged position and pulled away in accordance with an example embodiment.

FIGS. 3D and 4D illustrate the engaged catch members 41, 42 pulled away, such as when the carriage 30 is moved. It can be seen that the elongated member 60 has advanced along the pulley 58. In such a position, the interconnected biasing member 70 will impart its resistance force against movement of the carriage 30 in that direction.

With the catch members 41, 42 engaged to the engagement member 66, the corresponding biasing member 70 will impart a resistance force against movement of the carriage 30. The exerciser may repeat these steps as many times as needed to engage as many biasing members 70 as desired for their particular needs. As the carriage 30 is pulled back during performance of an exercise move, the catch members 41, 42, which are connected to the carriage 30, will function to pull the biasing member 70 such that the biasing member 70 stretches and imparts a resistance force against the carriage 30. Any disengaged biasing members 70 will remain in place, as their associated engagement members 66 will be retained by the retaining members 51, 52 in place below the resting position of the carriage 30.

When desired, the exerciser may choose to disengage one or more biasing members 70. The exerciser will generally adjust the respective arm member 46 into the disengaged position, such as by pulling on the arm member 46. As the arm member 46 recedes, it will release force against the catch members 41, 42. The springs 48 will then cause the catch members 41, 42 to revert back to their original position by pivoting in a reverse direction so as to disengage from the engagement member 66. The engagement member 66 will then remain in place underneath the resting position of the carriage 30, retained by the retaining members 51, 52.

It should also be appreciated that, in some embodiments, the catch members 41, 42 may be engaged or disengaged when the carriage 30 is not in the resting position. Put differently, the catch members 41, 42 may be engaged or disengaged while the carriage 30 is in transit or stopped at points other than its resting position over the retaining members 51, 52. The catch members 41, 42, retaining members 51, 52, and engagement member 66 may be shaped such that the catch members 41, 42 can be selected to be engaged or disengaged with the carriage 30 mid-travel, but will not shift until the carriage 30 returns to its original, resting (i.e., home) position.

For a mid-travel engagement in which the catch members 41, 42 are engaged when the carriage 30 is not in the resting position (e.g., when the carriage 30 is either in motion or stopped at a point other than its resting position), the arm member 46 may be engaged which will force the catch members 41, 42 into the engaged, lowered position. However, the catch members 41, 42 will not engage with the engagement member 66 until such time as the carriage 30 is returned to its resting position, since the engagement member 66 remains held by the retaining members 51, 52 when not so engaged.

As the carriage 30 returns to its resting position, the lowered catch members 41, 42 will pass over the engagement member 66 such that the engagement member 66 is bumped down the face of the retaining members 51, 52 by the catch members 41, 42 which are in the engaged position. The engagement member 66 is then instantly drawn back up to the previous position by the biasing member 70, and thus the engagement member 66 becomes engaged with the catch members 41, 42 such that the engagement member 66 will be drawn back with the catch members 41, 42 when the carriage 30 is next moved away from the resting position.

For a mid-travel disengagement in which the catch members 41, 42 are disengaged when the carriage 30 is not in the resting position, the arm member 46 may be disengaged. However, the force applied by the biasing member 70 will function to maintain the engagement member 66 within the catch members 41, 42 even after they have been disengaged until such time as the carriage 30 returns to its original, resting position. When the carriage 30 is so returned to its original, resting position, the engagement member 66, which is held by the catch members 41, 42, is caught (i.e., engaged) by the retaining members 51, 52. As the force from the biasing member 70 upon the catch members 41, 42 is then released, the catch members 41, 42 will be free to adjust into the disengaged position (e.g., by bias force applied by the springs 48) so as to fully disengage the engagement member 66 (and thus the interconnected biasing member 70) from the catch members 41, 42 for the next travel of the carriage 30.

Unless otherwise defined, all technical and scientific terms used herein have the same meaning as commonly understood by one of ordinary skill in the art to which this invention belongs. Although methods and materials similar to or equivalent to those described herein can be used in the practice or testing of the various embodiments of the present disclosure, suitable methods and materials are described above. All patent applications, patents, and printed publications cited herein are incorporated herein by reference in their entireties, except for any definitions, subject matter disclaimers or disavowals, and except to the extent that the incorporated material is inconsistent with the express disclosure herein, in which case the language in this disclosure controls. The various embodiments of the present disclosure may be embodied in other specific forms without departing from the spirit or essential attributes thereof, and it is therefore desired that the various embodiments in the present disclosure be considered in all respects as illustrative and not restrictive. Any headings utilized within the description are for convenience only and have no legal or limiting effect.

What is claimed is:

1. An exercise machine, comprising:

a frame including at least one rail;

a carriage movably connected to the at least one rail, wherein the carriage is adapted to be movable along a portion of the at least one rail;

a biasing member connected to the frame;

an engagement member connected to the biasing member;

a first catch member movably connected to the carriage, wherein the first catch member is adjustable between an engaged position and a disengaged position, wherein the first catch member is adapted to engage with the engagement member when the first catch member is in the engaged position such that the biasing member imparts a resistance force against movement of the carriage in at least one direction, and wherein the first catch member is adapted to release the engagement member when the first catch member is in the disengaged position;

a first retaining member connected to the frame, wherein the first retaining member is adapted to retain the engagement member when the engagement member is released from the first catch member; and a spring connected to the first catch member so as to bias the first catch member towards the disengaged position.

2. The exercise machine of claim 1, wherein the first catch member is comprised of a first hook.

3. The exercise machine of claim 2, wherein the first retaining member is comprised of a second hook.

4. The exercise machine of claim 1, wherein the first catch member is connected to an underside of the carriage.

5. The exercise machine of claim 1, wherein the first catch member extends downwardly from the carriage.

6. The exercise machine of claim 1, wherein the first retaining member extends upwardly from the frame.

7. The exercise machine of claim 1, further comprising an arm member connected to the first catch member.

8. The exercise machine of claim 7, wherein the arm member extends at least partially from a first end of the carriage.

9. The exercise machine of claim 1, further comprising a second catch member movably connected to the carriage, wherein the second catch member is distally-spaced with respect to the first catch member, and wherein a first gap is defined between the first catch member and the second catch member.

10. The exercise machine of claim 9, further comprising a second retaining member connected to the frame, wherein the second retaining member is distally-spaced with respect to the first retaining member, and wherein a second gap is defined between the first retaining member and the second retaining member.

11. The exercise machine of claim 10, wherein the second gap is wider than the first gap.

12. The exercise machine of claim 11, wherein the first catch member and the second catch member are spaced apart so as to fit within the second gap.

13. The exercise machine of claim 1, wherein the first catch member comprises a first opening, wherein the first retaining member comprises a second opening, and wherein the first opening is concentric with the second opening when the first catch member is engaged with the engagement member.

14. The exercise machine of claim 1, further comprising an elongated member connected to the biasing member, wherein the engagement member is connected to a distal end of the elongated member.

15. The exercise machine of claim 14, wherein the engagement member is oriented perpendicular to the distal end of the elongated member.

16. The exercise machine of claim 1, wherein the engagement member is crosswise with respect to the biasing member.

17. The exercise machine of claim 1, further comprising an end platform connected at or near a first end or a second end of the frame.

18. An exercise machine, comprising:

a frame including at least one rail;

a carriage movably connected to the at least one rail, wherein the carriage is adapted to be movable along a portion of the at least one rail;

a biasing member connected to the frame;

an elongated member including a first end and a second end, wherein the first end of the elongated member is connected to the biasing member;

an engagement member connected to the second end of the elongated member;

a first catch member pivotably connected to an underside of the carriage, wherein the first catch member is adjustable between an engaged position and a disengaged position, wherein the first catch member is adapted to engage with the engagement member when the first catch member is in the engaged position such that the biasing member imparts a resistance force against movement of the carriage in at least one direction, and wherein the first catch member is adapted to release the engagement member when the first catch member is in the disengaged position; and a first retaining member connected to the frame, wherein the first retaining member is adapted to retain the engagement member when the engagement member is released from the first catch member.

19. The exercise machine of claim 18, further comprising a pulley connected at or near a first end of the frame, wherein the elongated member is wound around the pulley.

20. An exercise machine, comprising:

a frame including at least one rail;

a carriage movably connected to the at least one rail, wherein the carriage is adapted to be movable along a portion of the at least one rail;

a biasing member connected to the frame;

an engagement member connected to the biasing member;

a first catch member movably connected to the carriage, wherein the first catch member is adjustable between an engaged position and a disengaged position, wherein the first catch member is adapted to engage with the engagement member when the first catch member is in the engaged position such that the biasing member imparts a resistance force against movement of the carriage in at least one direction, and wherein the first catch member is adapted to release the engagement member when the first catch member is in the disengaged position;

a first retaining member connected to the frame, wherein the first retaining member is adapted to retain the engagement member when the engagement member is released from the first catch member;

a second catch member movably connected to the carriage, wherein the second catch member is distally-spaced with respect to the first catch member, and wherein a first gap is defined between the first catch member and the second catch member; and a second retaining member connected to the frame, wherein the second retaining member is distally-spaced with respect to the first retaining member, and wherein a second gap is defined between the first retaining member and the second retaining member;

wherein the second gap is wider than the first gap.

21. An exercise machine, comprising:

a frame including at least one rail;

a carriage movably connected to the at least one rail, wherein the carriage is adapted to be movable along a portion of the at least one rail;

a biasing member connected to the frame;

an engagement member connected to the biasing member;

a first catch member movably connected to the carriage, wherein the first catch member is adjustable between an engaged position and a disengaged position, wherein the first catch member is adapted to engage with the engagement member when the first catch member is in the engaged position such that the biasing member imparts a resistance force against movement of the carriage in at least one direction, and wherein the first catch member is adapted to release the engagement member when the first catch member is in the disengaged position; and a first retaining member connected to the frame, wherein the first retaining member is adapted to retain the engagement member when the engagement member is released from the first catch member;

wherein the first catch member comprises a first opening, wherein the first retaining member comprises a second opening, and wherein the first opening is concentric with the second opening when the first catch member is engaged with the engagement member.

* * * * *